US010919170B2

(12) United States Patent
Fox et al.

(10) Patent No.: US 10,919,170 B2
(45) Date of Patent: Feb. 16, 2021

(54) FOOD PRODUCT SLICING APPARATUS

(71) Applicant: Formax, Inc., Mokena, IL (US)

(72) Inventors: Gage A. Fox, Manhattan, IL (US); Glen F. Pryor, Manhattan, IL (US); Fernando Garcia-Perez, Park Ridge, IL (US); Jeff Schmuker, Country Club Hills, IL (US)

(73) Assignee: PROVISUR TECHNOLOGIES, INC., Chicago, IL (US)

( * ) Notice: Subject to any disclaimer, the term of this patent is extended or adjusted under 35 U.S.C. 154(b) by 45 days.

(21) Appl. No.: 15/658,973

(22) Filed: Jul. 25, 2017

(65) Prior Publication Data

US 2017/0320225 A1 Nov. 9, 2017

Related U.S. Application Data

(62) Division of application No. 14/706,107, filed on May 7, 2015, now abandoned.

(Continued)

(51) Int. Cl.
*B26D 7/06* (2006.01)
*B26D 7/18* (2006.01)

(Continued)

(52) U.S. Cl.
CPC ..... *B26D 7/18* (2013.01); *B26D 7/0616* (2013.01); *B26D 7/0625* (2013.01); *B26D 7/30* (2013.01);

(Continued)

(58) Field of Classification Search
CPC ..... B26D 7/18; B26D 7/1818; B26D 7/0625; B26D 7/0683; B27B 25/04; Y10S 83/932;

(Continued)

(56) References Cited

U.S. PATENT DOCUMENTS 334,367 A * 1/1886 Fisher ..... B27B 25/04 83/435.2
2,126,458 A * 8/1938 Englen ..... B26D 7/0625 83/68

(Continued)

FOREIGN PATENT DOCUMENTS

| | | |
|---|---|---|
| DE | 19518583 | 11/1996 |
| EP | 2537651 | 12/2012 |
| JP | 52-8900 | * 1/1977 |

OTHER PUBLICATIONS

Supplementary European Search Report for corresponding European Patent Application No. 157896572 dated Jun. 20, 2018, 11 pages.

(Continued)

*Primary Examiner* — Clark F Dexter
(74) *Attorney, Agent, or Firm* — Klintworth & Rozenblat IP LLP

(57) ABSTRACT

A food product slicing apparatus includes a frame and upper and lower drive assemblies. The upper drive assembly includes a belt configured to engage an upper surface of a food product block to be sliced, a plate pivotally mounted to the frame, front and rear wheels supporting the upper belt, the front wheel rotatably mounted to the plate and a drive member engaged with the plate. When the drive member is engaged, the plate and the front roller pivot relative to the frame and to the rear wheel. The lower drive assembly includes a belt configured to engage a bottom surface of the food product block.

14 Claims, 20 Drawing Sheets

Related U.S. Application Data

(60) Provisional application No. 61/989,625, filed on May 7, 2014.

(51) Int. Cl.
*B26D 7/30* (2006.01)
*B65B 25/06* (2006.01)

(52) U.S. Cl.
CPC ..... *B65B 25/06* (2013.01); *B26D 7/0683* (2013.01); *Y10S 83/932* (2013.01); *Y10T 83/0538* (2015.04); *Y10T 83/182* (2015.04); *Y10T 83/2037* (2015.04); *Y10T 83/647* (2015.04); *Y10T 83/6499* (2015.04); *Y10T 83/6537* (2015.04); *Y10T 83/6633* (2015.04)

(58) Field of Classification Search
CPC ..... Y10T 83/647; Y10T 83/6579; Y10T 83/6633; Y10T 83/6656
USPC ..... 83/158–161, 165, 167, 932, 422, 435.2, 83/437.1, 401; 198/626.3, 626.5, 861.3
See application file for complete search history.

(56) References Cited

U.S. PATENT DOCUMENTS 4,709,535 A 12/1987 Mahaffy et al.
5,079,982 A * 1/1992 Antonissen ..... B26D 7/0625 198/626.5
5,458,051 A * 10/1995 Alden et al. ..... A47J 37/044 198/626.5
5,974,925 A * 11/1999 Lindee et al. ..... B26D 1/0006 83/403.1
8,408,109 B2 * 4/2013 Lindee et al. ..... B26D 7/088 83/435.16
2008/0250904 A1 10/2008 Seager
2009/0188363 A1 7/2009 Lindee et al.
2011/0099948 A1 5/2011 Drebing et al.
2013/0074667 A1 3/2013 Weber et al.
2013/0160620 A1 6/2013 Reifenhaeuser
2013/0305892 A1 * 11/2013 Nobukuni ..... B26D 1/0006 83/13

OTHER PUBLICATIONS

Machine translation for DE19518583A1.
Machine translation for EP2537651A1.
Supplementary European Search Report for corresponding European Patent Application No. 15789657.2 dated Jan. 4, 2018, 10 pages.
International Search Report and Written Opinion for PCT/US2015/29630 dated Aug. 11, 2015, 15 pages.
Canadian Office Action for corresponding Canadian Patent Application No. 2,994,075 dated Nov. 19, 2018, 4 pages.

* cited by examiner

FOOD PRODUCT SLICING APPARATUS

This application is a divisional application of U.S. Ser. No. 14/706,107, filed on May 7, 2015, and claims the domestic benefit of U.S. Provisional Application Ser. No. 61/989,625, filed on May 7, 2014, the contents of which are incorporated herein in its entirety.

FIELD OF THE INVENTION

The present disclosure generally relates to an apparatus for slicing food products and, more particularly, to improvements to an apparatus for slicing food products.

BACKGROUND

Food product slicing machines have existed for some time and are used to slice various food products at a high-speed rate. Exemplary food products include meat, such as beef, chicken, fish, pork, etc., and cheese. Various deficiencies have been identified with such food product slicing machines.

Conventional food product slicing machines include a product gate that holds back a food product block (typically a large block of frozen food product having a relatively significant weight) and a gripper that grips a rear of the food product block. When the food product gate is lowered, the gripper is the only mechanism retaining the food product block and preventing the block from moving forward toward a slicing station where the food product block is ultimately sliced by a blade. Due to the significant weight of the food product block, the gripper often fails and the heavy food product block may fall or advance forward out of control of any mechanism of the slicing machine. The free-falling food product block may damage components of the slicing machine and/or become misaligned, thereby inhibiting operation of the slicing machine.

Conventional food product slicing machines may also include a lower drive mechanism that engages a smaller portion or surface area of the food product block. Engaging such a small portion or surface area of a food product block inhibits precise control of the food product block, which may result in inaccurate slicing of the food product block, slippage of the lower drive mechanism against the food product block, or non-linear driving of the food product block (i.e., the food product block may skew, angle, or otherwise become non-linear with a driving direction of the food product block).

Conventional food product slicing machines also include either a single safety sensor for sensing a limited area around the slicing machine to inhibit individuals from being injured by the slicing machine or conventional slicing machines may include mechanical or structural shields erected on the slicing machine to similarly inhibit injury to individuals. The slicing machines including a single sensor have the single sensor positioned on an operator side of the machine. Slicing machines with mechanical or structural shields inhibit movement of the slicing machines between raised and lower positions, and inhibit cleaning of the machine because the shields are difficult to clean around or the shields need to be removed prior to cleaning, thereby making the cleaning process a timely endeavor and also decrease the effectiveness of the cleaning process because additional structure must be cleaned.

Furthermore, conventional food product slicing machines may simultaneously slice multiple food product blocks, thereby creating multiple stacks of sliced food product. Each of the stacks of sliced food product is positioned on its own conveyor and travels on the respective conveyor away from the slicing station along a path. The conveyors and associated paths are transverse and not parallel to each other as the stacks of sliced food product move between the slicing station and a weighing station, thereby increasing the distance the stacks of sliced food product need to travel between the slicing station and the weighing station. Similarly, the conveyors and associated paths are transverse and non-parallel relative to each other between the slicing station and the packaging station, thereby increasing the distance the stacks of food product need to travel between the slicing station and the packaging station. Stated in another manner, all of the conveyors and associated paths are non-linear from the slicing station to the weighing station or from the slicing station to the packaging station. These orientations of conveyors and associated paths increase a footprint of the machine and increase the time required to move the stacks of sliced food product from the slicing station to the weighing station or the packaging station.

Moreover, conventional food slicing machines have limited capability to accommodate food product blocks of varying heights. Typically, food slicing machines can accommodate only one size of food product block with very little deviation therefrom. Additionally, conventional slicing machines may simultaneously slice multiple food product blocks and such conventional slicing machines cannot accommodate variance in the size of the multiple food product blocks.

SUMMARY

Thus, a need exists for a food product slicing machine or apparatus that resolves one or more of the deficiencies identified above or other deficiencies of food slicing machines.

In one aspect, a food product slicing apparatus is provided.

In one aspect, a food product slicing apparatus is provided and includes a frame and upper and lower drive assemblies. The upper drive assembly includes a belt configured to engage an upper surface of a food product block to be sliced, a plate pivotally mounted to the frame, front and rear wheels supporting the upper belt, the front wheel rotatably mounted to the plate and a drive member engaged with the plate. When the drive member is engaged, the plate and the front roller pivot relative to the frame and to the rear wheel. The lower drive assembly includes a belt configured to engage a bottom surface of the food product block.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
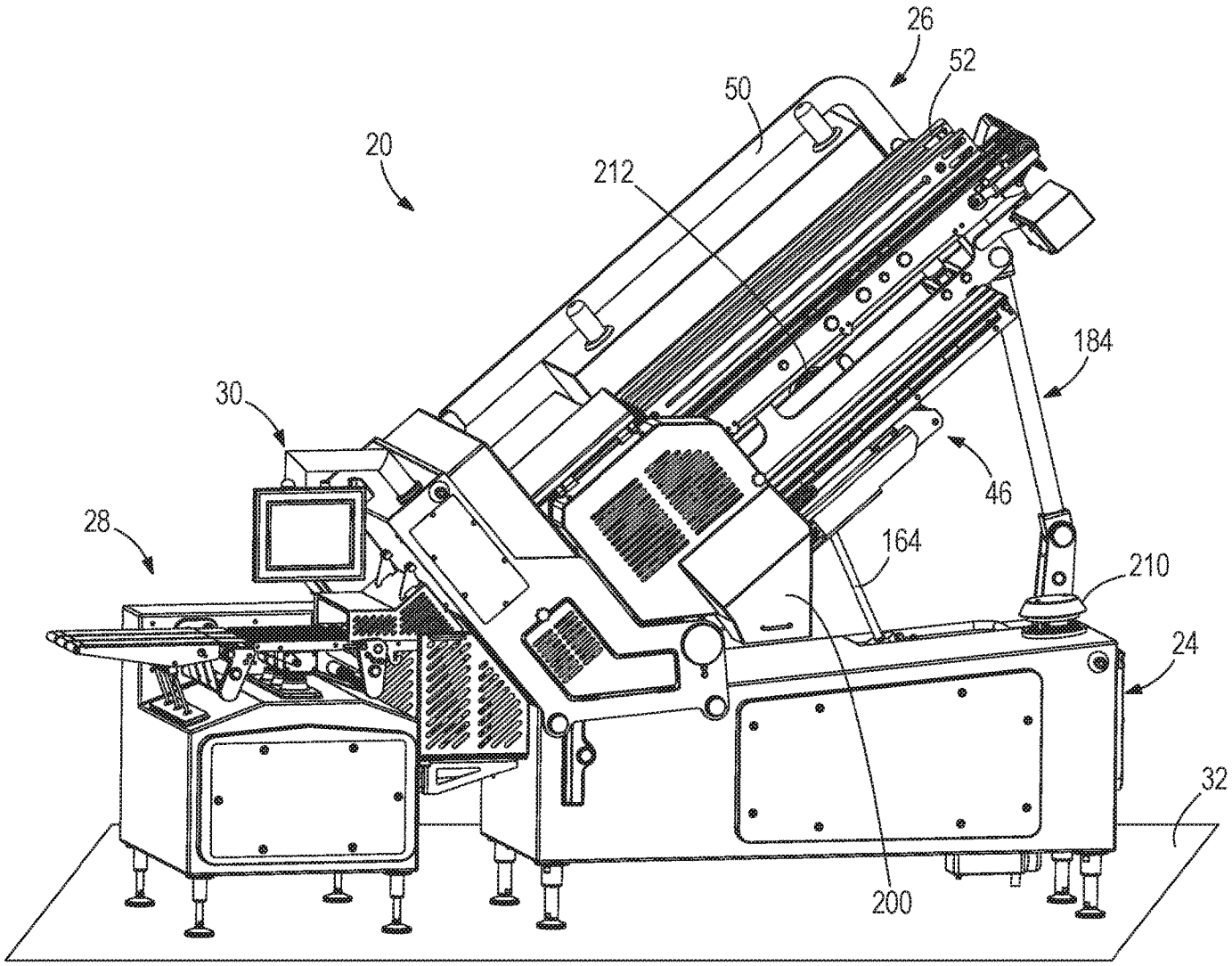
FIG. 1 is a top, front perspective view of one example of a food product slicing apparatus, according to one aspect of the present disclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Food product slicing apparatuses and methods associated with the same are included in the present disclosure. The food product slicing apparatuses and methods have benefits over conventional food product slicing apparatuses. For example, the food product slicing apparatuses and methods have one or more of improved food product block control, increased safety without inhibiting cleaning of the food product slicing apparatus, a smaller footprint, and capability of accommodating food product blocks of various heights, among other benefits.

With reference to the figures, one example of a food product slicing apparatus 20 is shown. The food product slicing apparatus 20 is used to slice food product blocks 22 into slices. The food product blocks 22 may be comprised of a wide variety of edible materials including, but not limited to meat, such as beef, chicken, fish, pork, etc., and cheese. In some examples, the food product blocks 22 are frozen.

The food product slicing apparatus 20 includes a base 24, an input and slicing portion 26 pivotally mounted on the base 24, an output portion 28 mounted on the base 24 and downstream of the input and slicing portion 26, and a control system 30 configured to control operation of the food product slicing apparatus 20. The control system 30 may be mounted on the base 24. The base 24 supports the input and slicing portion 26, the output portion 28, and the control system 30 on a ground surface 32 and includes various mechanisms and power systems for powering the food product slicing apparatus 20. The input and slicing portion 26 is configured to support and handle the food product blocks 22, to move the food product blocks 22 and to slice the food product blocks 22 into slices. The sliced food product is supported on the output portion 28 of the food product slicing apparatus 20 in stacks and is moved away from the input and slicing portion 26 by the output portion 28. The control system 30 includes all the necessary hardware and software to perform all of the operations and functions of the food product slicing apparatus 20.

Figure 2:
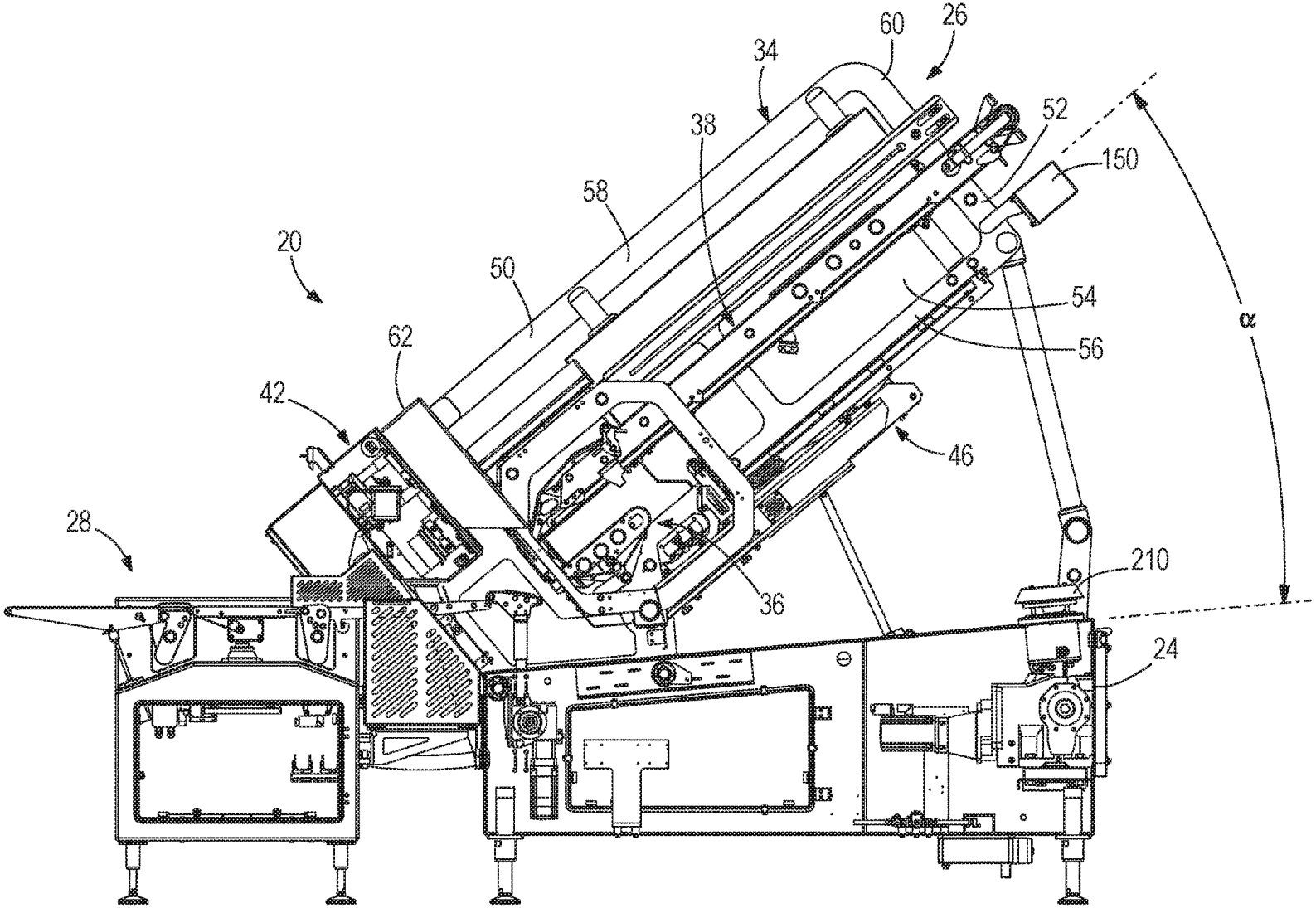
FIG. 2 is a cross-sectional view of the food product slicing apparatus, according to one aspect of the present disclosure.

With reference to FIGS. 1 and 2, the input and slicing portion 26 includes a frame 34, a lower drive assembly 36 mounted on the frame 34, an upper drive assembly 38 mounted on the frame 34 and which is movable relative to the frame 34 and relative to the lower drive assembly 36, a shear edge 40 mounted on the frame 34 and which is downstream of the lower drive assembly 36, a slicing station 42 mounted on the frame 34 and which is downstream of the shear edge 40, a removal member 44 mounted on the frame 34 upstream of the lower drive assembly 36, and a tray 46 mounted on the base 24 and upstream of the lower drive assembly 36.

The input and slicing portion 26 is pivotally mounted to the base 24 around pivot 48. The tray 46 is pivotally mounted to the frame 34 around pivot 48, such that the tray 46 is pivotable relative to the lower and upper drive assemblies 36, 38, the shear edge 40 and the slicing station 42. The lower and upper drive assemblies 36, 38 move food product blocks 22 from the tray 46 to the shear edge 40 and into the slicing station 42.

The frame 34 includes a pair of upstanding plates 50, 52, each of which has a least one aperture 54 therethrough. As a result, each plate 50, 52 includes a lower section 56, an upper section 58, an upstream section 60 and a downstream section 62. A pair of spaced apart support arms extend between the lower sections 56 of the plates 50, 52. A support rod 64, 65 extends upwardly from each support arm between the plates 50, 52 such that first and second support rods are defined, and an upper end of each support rod 64, 65 is affixed to the upper section 58 of the plate 50.

Figure 5:
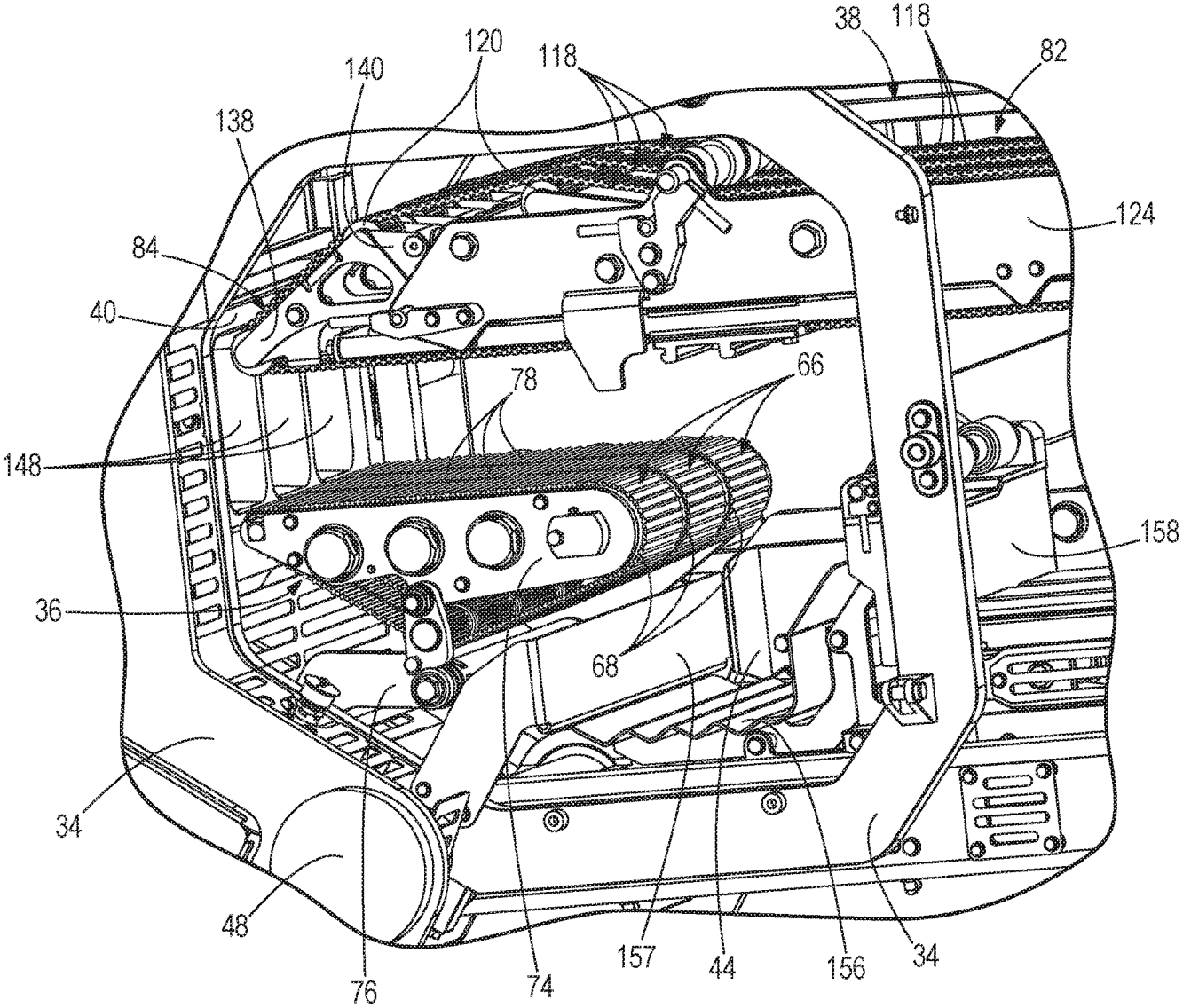
FIG. 5 is a cross-sectional view taken along a vertical plane extending through the food product slicing apparatus, according to one aspect of the present disclosure.
Figure 6:
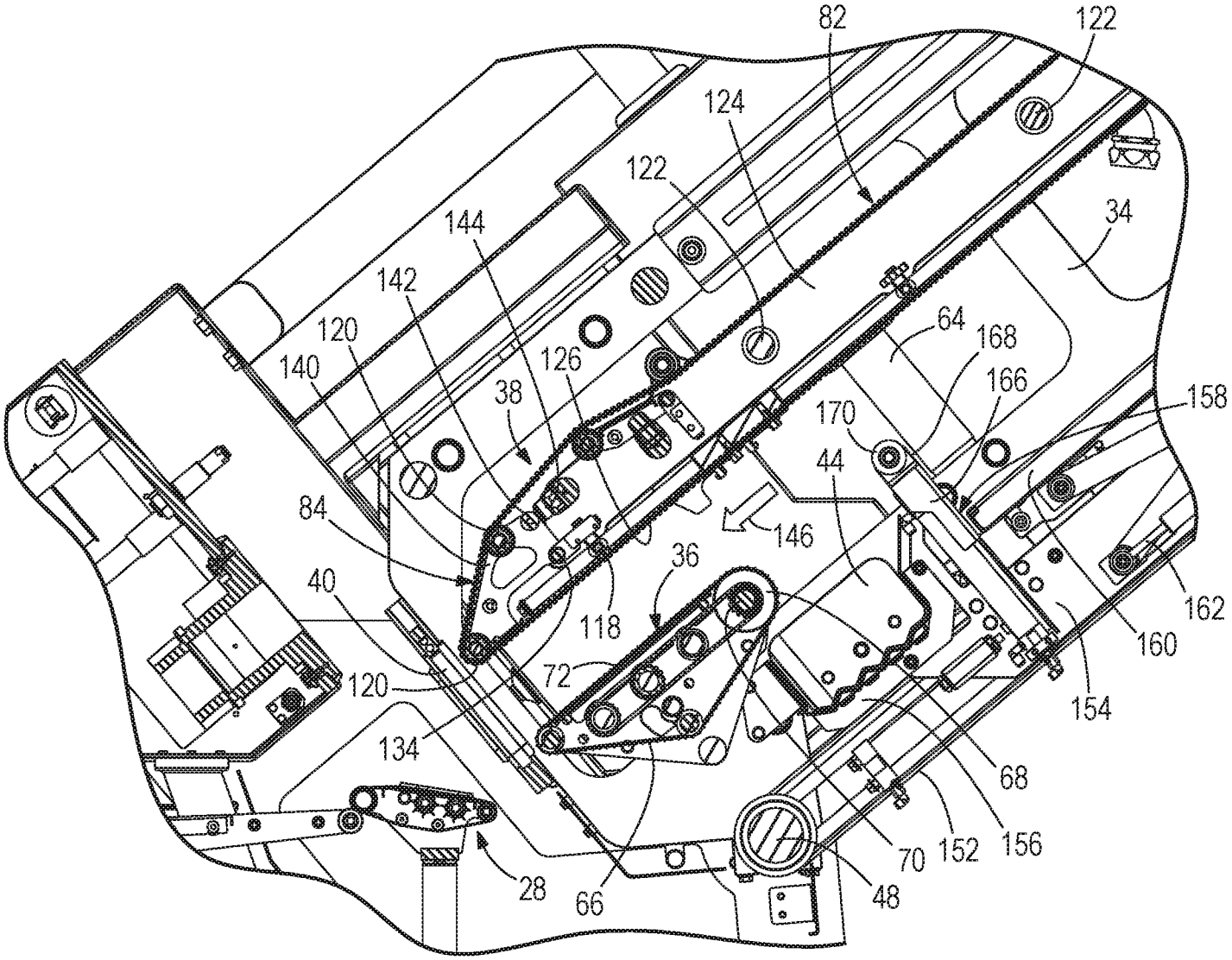
FIG. 6 is a cross-sectional view taken along a vertical plane extending through the food product slicing apparatus, according to one aspect of the present disclosure.

The lower drive assembly 36 is mounted on a downstream portion of the plate 52. With reference to FIGS. 5 and 6, the illustrated example of the lower drive assembly 36 includes a plurality of endless drive belts 66, one for each food product block 22. Each endless drive belt 66 wraps around a plurality of wheels 68, with at least one of the wheels 68 being a drive wheel or being driven by a separate drive wheel. The wheels 68 are supported by shafts 70 which are cantilevered from and rotatably mounted to the upstream section of the plate 52. The endless drive belts 66 define planar upper surfaces 72 upon which food product blocks 22 will translate. A motor (not shown) is provided to drive the shaft supporting the drive wheel. A second end of each shaft 70 is rotatably attached to a plate 74. The plate 74 is attached to the downstream section of the frame 34 by a belt tensioning assembly 76, the specifics of which are not described herein.

Each belt 66 includes a tactile surface 78 configured to engage bottom surfaces of the food product blocks 22. In the illustrated example, the tactile surface 78 of each belt 66 is an exterior surface of the belt 66. The tactile surfaces 78 of the belts 66 may have a variety of configurations to ensure adequate engagement, grip, friction, etc., between the belts 66 and the food product blocks 22. In one example, the tactile surface 78 may include a corrugation shape, thereby providing alternating projections and recesses. In another example, the tactile surface 78 may include projections extending therefrom having any shape.

A downstream end of the upper drive assembly 38 is mounted on the support rods 64, 65 of the frame 34 and is movable relative thereto. The upper drive assembly 38 extends from the downstream end of the frame 34 to the upstream end of the frame 34. As such, the upstream end of the upper drive assembly 38 is positioned above the lower drive assembly 36.

An upstream end of the upper drive assembly 38 is mounted on the support rods 64, 65 of the frame 34 and is movable relative thereto. The upper drive assembly 38 extends from the upstream end of the frame 34 to the downstream end of the frame 34. As such, the downstream end of the upper drive assembly 38 is positioned above the lower drive assembly 36.

Figure 8:
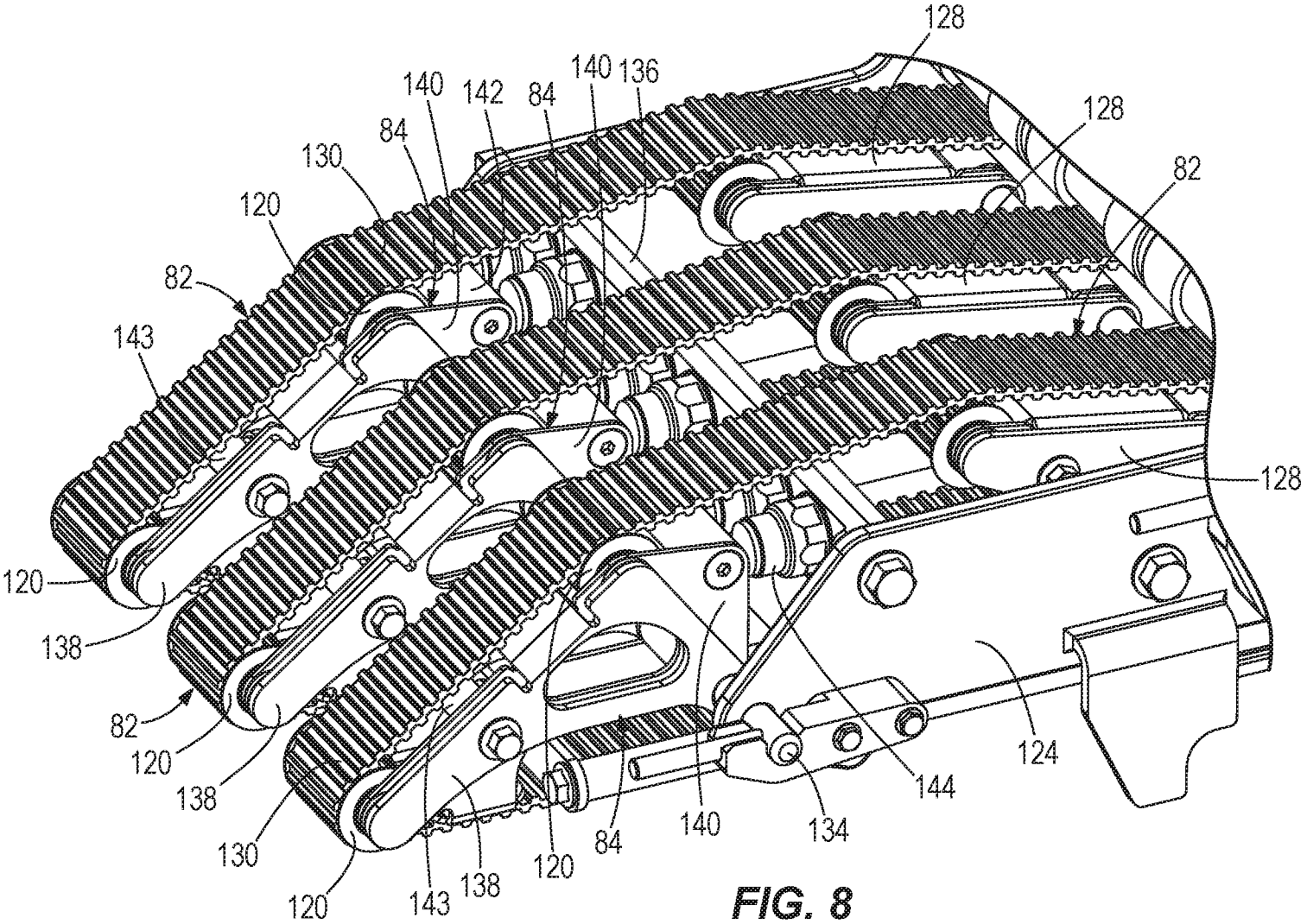
FIG. 8 is an enlarged partial view of the food product slicing apparatus showing one example of a portion of an upper drive assembly with pressure adjustment assemblies, according to one aspect of the present disclosure.

As shown in FIGS. 5, 6 and 8, the upper drive assembly 38 includes a housing 80, a plurality of belt and wheel assemblies 82 mounted to the housing 80, and pressure adjustment assemblies 84. The pressure adjustment assemblies 84 are attached to the upstream ends of the belt and wheel assemblies 82 to apply varying pressures to top surfaces of the food product blocks 22 as food product blocks 22 engage with the upper drive assembly 38. A height adjustment assembly 86 is mounted within the housing 80 to adjust the height of the upper drive assembly 38 relative to the frame 34 and relative to the lower drive assembly 36.

The housing 80 has a pair of upright side walls 87, 88, a bottom wall 90 and a top wall 92. The support rods 64, 65 extend through the bottom and top walls 90, 92 and the housing 80 is slidable on the support rods 64, 65 as discussed herein.

The distance the upper drive assembly 38 is spaced from the lower drive assembly 36 is adjustable by the height adjustment assembly 86 to correspond to a height of food product blocks 22 that will be sliced by the food product slicing apparatus 20. Food product blocks 22 come in a variety of heights and such heights may vary depending on a variety of factors such as, for example, type of food product, type of machine used to form the food product blocks 22, etc. The height adjustment assembly 86 includes an actuator 94, a first pivot member 98, a first pivot shaft 100, a first plurality of slide members 102, a first connecting frame 104, a second pivot member 106, a second pivot shaft 108, a second plurality of slide members 110, a second connecting frame 112, a connecting bar 114, and a cam slot 116, 117 which is formed on each of the rods 64, 65.

The actuator 94 is mounted on the side wall 88 of the housing 80. A piston of the actuator 94 is extendable and retractable. A rocker member 96 of the actuator 94 is attached to the end of the piston and is fixedly mounted on the first pivot shaft 100 such that the rocker member 96 does not pivot relative to the first pivot shaft 100

The first pivot shaft 100 extends between the side walls 87, 88 of the housing 80 and is rotatably attached thereto. The first pivot shaft 100 is attached to the housing 80 proximate to the upstream end of the housing 80. The first pivot member 98 is fixedly mounted on the first pivot shaft 100 such that the first pivot member 98 does not pivot relative to the first pivot shaft 100. The lower end of the first pivot member 98 is attached to the rod 64. The rod 64 has the cam slot 116 formed therein and the lower end of the first pivot member 98 has a pin 119 extending therefrom which seats in the cam slot 116. Upon rotation of the first pivot member 98 relative to the housing 80, the pin 119 slides along the cam slot 116. The motion of the pin 119 is restrained by the length of the cam slot 116.

The first pivot shaft 100 extends between the side walls 87, 88 of the housing 80 and is rotatably attached thereto. The first pivot shaft 100 is attached to the housing 80 proximate to the downstream end of the housing 80. The first pivot member 98 is fixedly mounted on the first pivot shaft 100 such that the first pivot member 98 does not pivot relative to the first pivot shaft 100. The lower end of the first pivot member 98 is attached to the rod 65. The rod 64 has the cam slot 116 formed therein and the lower end of the first pivot member 98 has a pin 119 extending therefrom which seats in the cam slot 116. Upon rotation of the first pivot member 98 relative to the housing 80, the pin 119 slides along the cam slot 116. The motion of the pin 119 is restrained by the length of the cam slot 116.

The second pivot shaft 108 extends between the side walls 87, 88 of the housing 80 and is rotatably attached thereto. The second pivot member 106 is fixedly mounted proximate to the upstream end of the housing 80 on the second pivot shaft 108 such that the second pivot member 106 does not pivot relative to the second pivot shaft 108. The lower end of the second pivot member 106 is attached to the rod 65. The rod 65 has the cam slot 117 formed therein and the lower end of the second pivot member 106 has a pin 121 extending therefrom which seats in the cam slot 117. Upon rotation of the second pivot member 106 relative to the housing 80, the pin 121 slides along the cam slot 117. The motion of the pin 121 is restrained by the length of the cam slot 117.

The cam slots 116, 117 are horizontal when the bottom wall 90 of the housing 80 is parallel to the ground surface 32.

The connecting bar 114 extends between upper ends of the first and second pivot members 98, 106 such that the rocker member 96, the pivot members 98, 106 and the pivot shafts 100, 108 will move in unison relative to the housing 80 and the rods 64, 65.

The first slide members 102 form rings around the support rod 64 and are slidable relative to the support rod 64. The connecting frame 104 is fixedly attached to each slide member 102 on an opposite side of the support rod 64 to that where the first pivot member 98 is attached. The connecting frame 104 is affixed to the side walls 87, 88 of the housing 80. The second slide members 110 form rings around the support rod 65 and are slidable relative to the support rod 65. The connecting frame 112 is fixedly attached to each slide member 110 on an opposite side of the support rod 65 to that where the second pivot member 106 is attached. The connecting frame 112 is affixed to the side walls 87, 88 of the housing 80.

Figure 9:
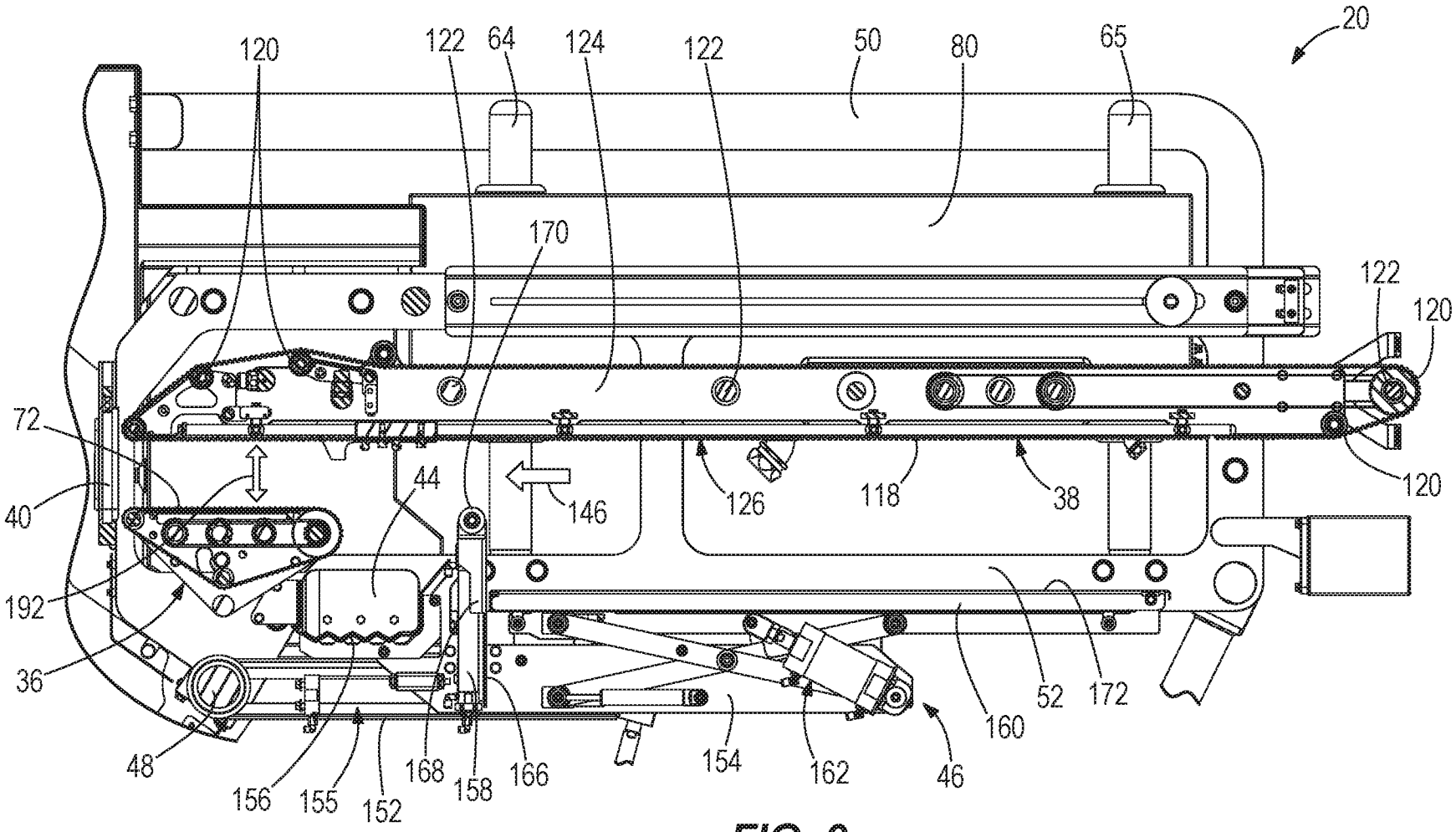
FIG. 9 is a cross-sectional view taken along a vertical plane extending through the food product slicing apparatus, according to one aspect of the present disclosure.
Figure 10:
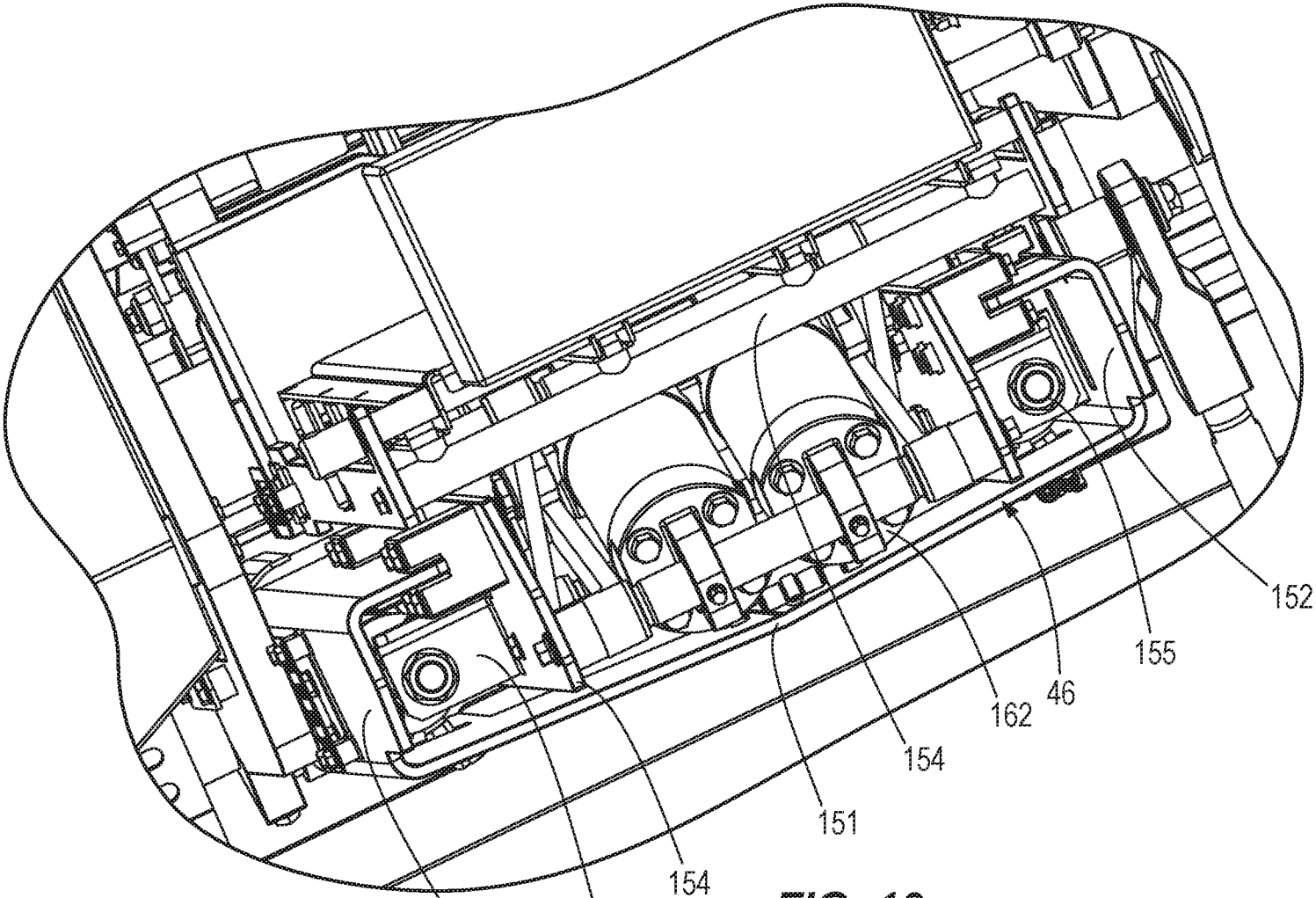
FIG. 10 is side elevation view of a portion of the food product slicing apparatus showing details of a tray.

With reference to FIGS. 2, 6, 9, the illustrated example of the belt and wheel assemblies 82 includes a plurality of endless drive belts 118, one for each food product block 22. Each endless drive belt 118 wraps around a plurality of wheels 120, with at least one of the wheels 120 being a drive wheel or being driven by a separate drive wheel. The wheels 120 are supported by shafts 122, some of which extend from the side wall 88 of the housing 80 to a plate 124 and other of which extend between plate 124 and an opposite plate (not shown) or are provided as part of the pressure adjustment assemblies 84. The endless drive belts 118 define planar lower surfaces 126 upon which food product blocks 22 will translate (the drive belts 118 are planar subject to use of the pressure adjustment assemblies 84 as described herein). A motor (not shown) is provided to drive the shaft supporting the drive wheel. A belt tensioning assembly 128, the specifics of which are not described herein, is provided at the downstream section of each belt and wheel assembly 82.

The drive belts 118 include a tactile surface 130 configured to engage top surfaces of the food product blocks 22. In the illustrated example, the tactile surface 130 of each belt 118 is an exterior surface of the belt 118. The tactile surfaces 130 may have a variety of configurations to ensure adequate engagement, grip, friction, etc., between the belts 118 and the food product blocks 22. In one example, the tactile surface 130 may include a corrugation shape, thereby providing alternating projections and recesses. In another example, the tactile surface 130 may include projections extending therefrom having any shape.

Figure 11:
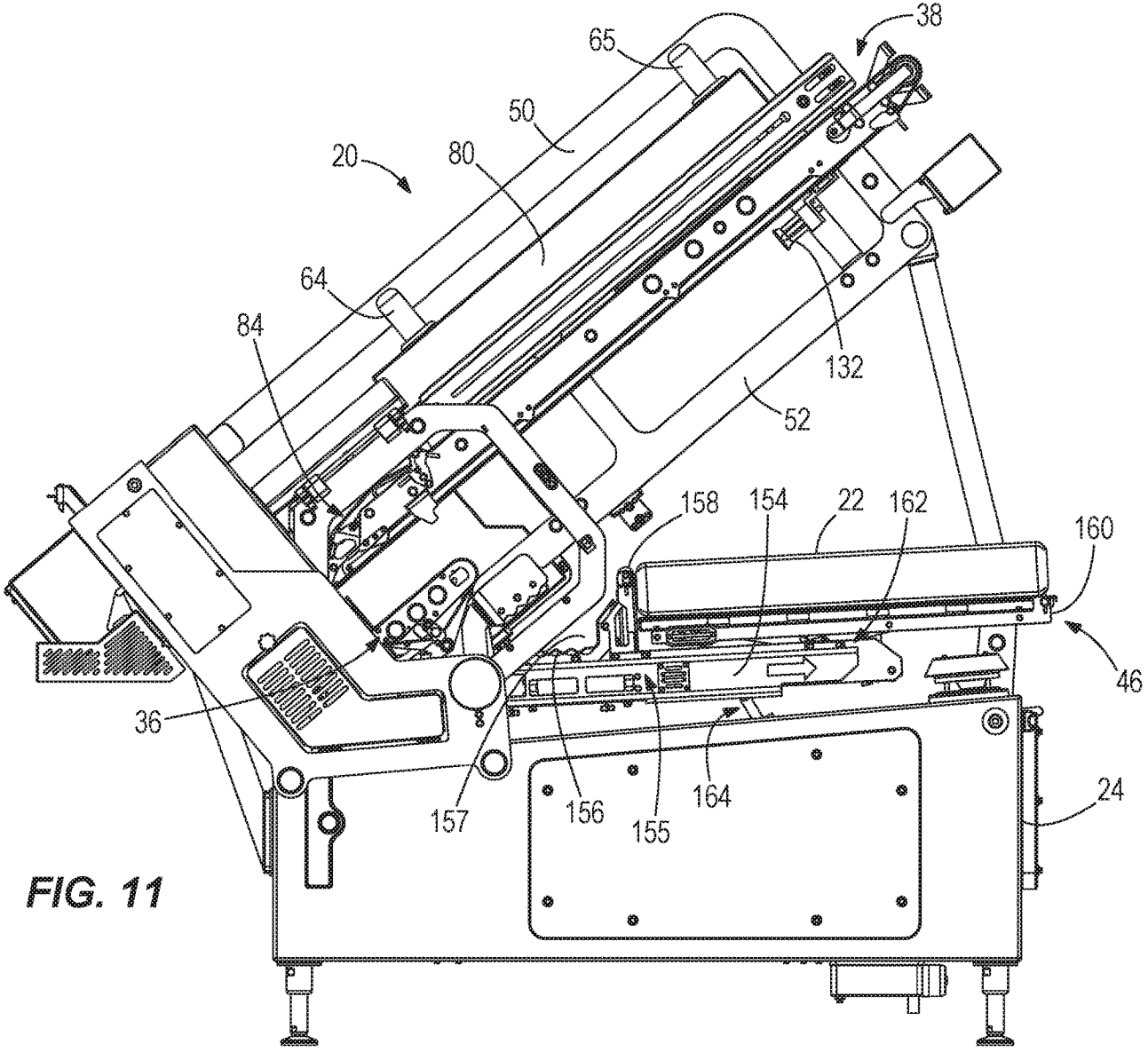
FIG. 11 is an elevation view of the food product slicing apparatus with an example of a food product block loaded onto one example of a tray, according to one aspect of the present disclosure.

With additional reference to FIG. 11, each belt 118 has a gripper 132 coupled thereto. Such grippers 132 are known in the art. The grippers 132 move with the belts 118. The grippers 132 have an adjustment mechanism for moving the grippers 132 relative to the belts 118.

The pressure adjustment assemblies 84 are attached at the downstream end of the belt and wheel assemblies 82. Referring now to FIGS. 5 and 8, the pressure adjustment assemblies 84 are used to apply varying pressures to top surfaces of the food product blocks 22 as they engage with the upper drive assembly 38. Each pressure adjustment assembly 84 includes the forwardmost wheels 120 of the individual belt and wheel assemblies 82 and are capable of moving the forwardmost wheels 120 toward or away from the lower drive assembly 36.

A pivot shaft 134 extends between the front ends of the plates (124 and the other plate is not shown) and is used to mount the pressure adjustment assemblies 84 thereon. In addition, a mounting bar 136 extends between the front ends of the plates (124 and the other plate is not shown) at a position which is above and rearwardly of the pivot shaft 134.

Each pressure adjustment assembly 84 is identically formed and only one of the pressure adjustment assemblies 84 is described for ease in description. The pressure adjustment assembly 84 includes a pair of mounting plates 138 (only one of which is shown) which are mounted on the pivot shaft 134 at a rearward end of each mounting plate 138. The forwardmost wheels 120 are mounted between the mounting plates 138. The pressure adjustment assembly 84 further includes a pair of adjusting plates 140 (only one of which is shown) which have a shaft 142 extending therebetween. Each adjusting plate 140 is attached to the pivot shaft 134 at its lower, rearward end and to the shaft 142 at its upper, rearward end. The mounting plates 138 and adjusting plates 140 are affixed together by a shaft 143. Alternatively, the respective mounting plates 138 and respective adjusting plates 140 can be formed as a single component. The pressure adjustment assembly 84 additionally includes a drive member 144. The drive member 144 is mounted on the mounting bar 136 and engages with the shaft 142. The drive member 144 may be a wide variety of types of drive members including, but not limited to, pneumatic, hydraulic, screw drive, electronic, etc., and all of such possibilities are intended to be within the spirit and scope of the present disclosure.

The removal member 44 is mounted on the lower section 56 of the plate 52 proximate to the upstream end of the lower drive assembly 36. The removal member 44 translates in a direction generally perpendicular to feed paths 146 of the food product blocks 22. The removal member 44 may be driven in a variety of manners including, but not limited to, pneumatically, hydraulically, screw drive, or any other appropriate manner.

The shear edge 40 is conventional and defines a plurality of apertures 148, one for each food product block 22. The shear edge 40 is attached to the downstream portion of the frame 34, and is downstream of the lower and upper drive assemblies 36, 38.

The belts 66 of the lower drive assembly 36 linearly align with the belts 118 of the upper drive assembly 38. The belts 66, 118 linearly align with the apertures 148 in the shear edge 40.

The slicing station 42 is conventional and the specifics are not described herein. The slicing station 42 includes a blade which moves upwardly and downwardly relative to the shear edge 40 to slice the food product blocks 22 into individual slices.

A food product block sensor 150 is mounted on the upstream section of the frame 34 and aligns with the lower drive assembly 36. The food product block sensor 150 is in communication with the control system 30.

The tray 46 is pivotally mounted to the frame 34 and is pivotable relative to the lower and upper drive assemblies 36, 38, the shear edge 40 and the slicing station 42. The tray 46 is configured to support a plurality of food product blocks 22.

Referring now to FIG. 9, the tray 46 includes a housing 151 including a pair of arms 152 pivotally mounted on the frame 34 at pivot 48, a base 154 attached to the arms 152, a first drive mechanism 155 for translating the base 154 relative to the arms, a butt receiving wall 156 provided on the base 154, a product gate 158 mounted on the base 154, a support member 160 mounted on the base 154 by a second drive mechanism 162 for adjusting the position of the support member 160 relative to the base 154, and a third drive mechanism 164 for pivoting the tray 46 relative to the base 154 and to the frame 34. The product gate 158 is downstream of the support member 160, and the butt receiving wall 156 is downstream of the product gate 158. The pivot 48 is downstream of the butt receiving wall 156.

The arms 152 are elongated and extend from the pivot 48. The arms 152 can pivot relative to the frame 34 at pivot 48.

The base 154 is attached between the arms 152 by the first drive mechanism 155, which are formed by drive members. Each drive member has a first end attached to a respective arm 152 and a second end attached to the base 154. The drive members may be a wide variety of types of drive members including, but not limited to, pneumatic, hydraulic, screw drive, electronic, etc., and all of such possibilities are intended to be within the spirit and scope of the present disclosure. When the drive members are activated, the base 154 translates along the length of the arms 152.

The butt receiving wall 156 is mounted at the downstream end of the base 154. The butt receiving wall 156 extends upwardly from a top surface of the base 154, and may be generally U-shaped as shown. The inner surface of the butt receiving wall 156 defines a cavity 157 and may have corrugations thereon.

The product gate 158 is formed of an upright housing 166 having a plurality of rods 168 mounted therein. Each rod 168 has a rotatable roller 170 mounted at is upper end. The rods 168 can be extended upwardly from the housing 166 and retracted back into the housing 166, such that the rollers 170 can be moved upwardly and then downwardly relative to the base 154. The rods 168 are driven by a drive member and may be a wide variety of types of drive member including, but not limited to, pneumatic, hydraulic, screw drive, electronic, etc., and all of such possibilities are intended to be within the spirit and scope of the present disclosure.

The support member 160 has a planar top surface 172 which engages a bottom of the food product blocks 22 to support the food product blocks 22 from below.

The second drive mechanism 162 is disposed between the base 154 and the support member 160 to move the support member 160 and the food product blocks 22 away from the base 154. In one example, the drive mechanism 162 moves the support member 160 and food product blocks 22 in a direction perpendicular to a longitudinal extent of the lower base 154. In one example, the drive mechanism 162 is a scissor drive mechanism.

The third drive mechanism 164 extends between the base 24 and the bottom of the base 154. The third drive mechanism 164 may be a wide variety of types of drive members including, but not limited to, pneumatic, hydraulic, screw drive, electronic, etc., and all of such possibilities are intended to be within the spirit and scope of the present disclosure.

Figure 3:
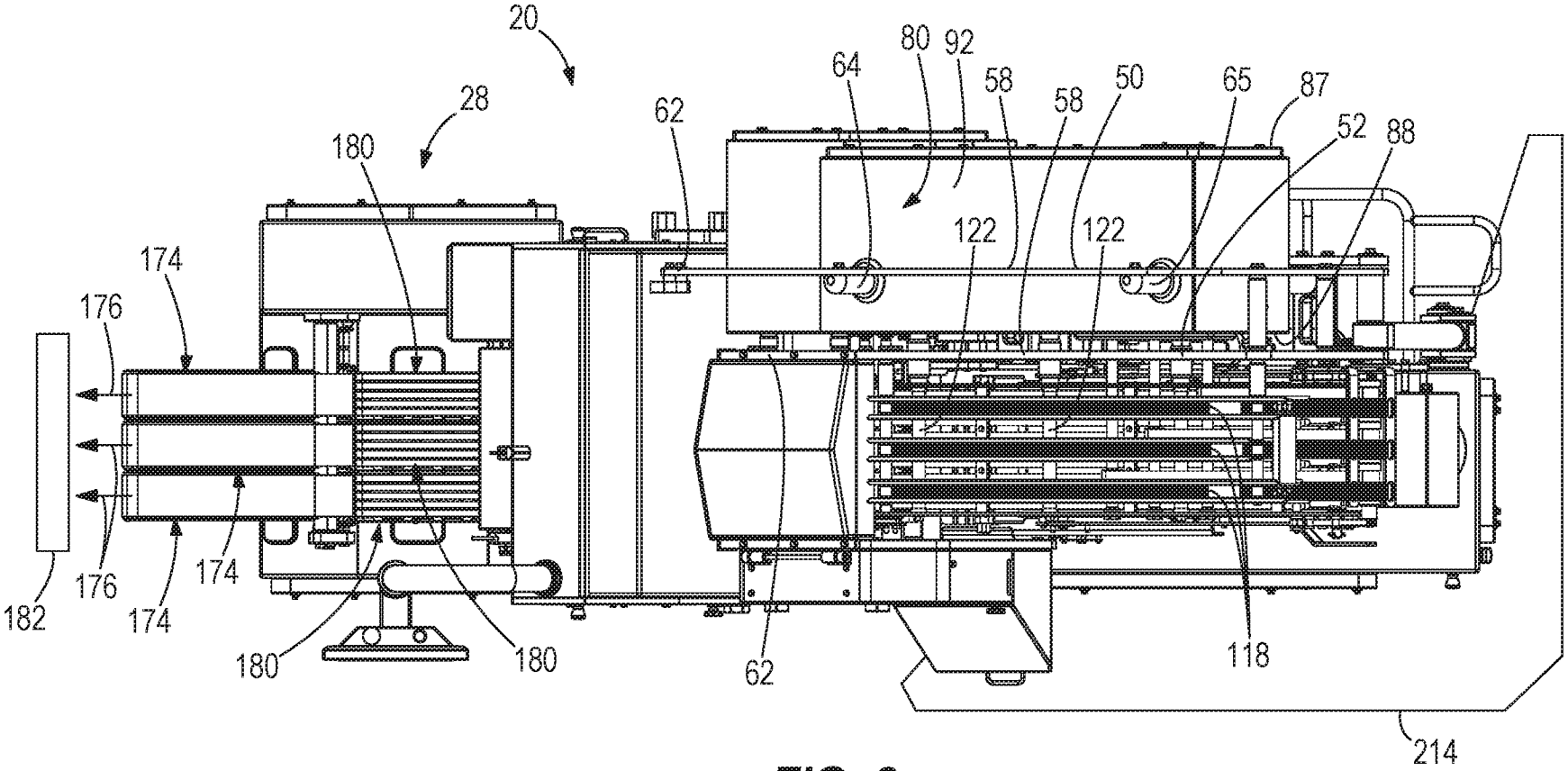
FIG. 3 is a top view of the food product slicing apparatus illustrating one example of a first zone sensed by a first sensor, according to one aspect of the present disclosure.

Referring now to FIGS. 1 and 3, the output portion 28 of the food product slicing apparatus 20 is illustrated and will be described in more detail. The output portion 28 includes a plurality of conveyors 174, one for each stack of food products sliced from the corresponding food product blocks 22. In the illustrated example, the output portion 28 includes three conveyors 174 to correspond to three food product blocks 22. In other examples, the output portion 28 may include any number of food product blocks 22 and a corresponding number of conveyors 174 to accommodate the sliced food stacks resulting from the food product blocks 22. The conveyors 174 are all linear and parallel to each other to convey the sliced food product stacks in a linear path 176 away from the slicing station 42. The conveyors 174 linearly align with the belts 66, 118 of the lower and upper drive assemblies 36, 38.

The output portion 28 also includes a plurality of weighing stations 180 formed by weighing scales, one associated with each conveyor 174. The weighing scales weigh each stack of sliced food product to ensure an appropriate amount of food product in each stack. The weighing scales are oriented under the conveyors 174 and are positioned close together.

The linear and parallel output conveyors 174, along with the closely positioned weighing scales, decrease the overall footprint occupied by the conveyors 174 and the output portion 28 as a whole. Additionally, the linear and parallel output conveyors 174 along with the closely positioned weighing scales provide a shortest possible travel path for the sliced food stacks from the slicing station 42 to various downstream points such as, for example, the weighing station 180 (i.e., the location of the weighing scales), the packaging station 182 (i.e., the location where the sliced food product stacks are placed in packaging), etc. Thus, the sliced food product stacks move along linear paths 176 from the slicing station 42 to the weighing station 180, and move along linear paths 176 from the slicing station 42 to the packaging station 182.

Now that the specifics of the components of the food product slicing apparatus 20 have been described, the operation of the food product slicing apparatus 20 is described.

Initially, the food product slicing apparatus 20 is in a load position as shown in FIG. 11 to facilitate loading of food product blocks 22 onto the tray 46. The tray 46 is in a lowered and rearward position. The butt receiving wall 156 is provided downstream of the tray 46 between the tray 46 and the lower drive assembly 36. The grippers 132 are proximate to the upstream end of the upper drive assembly 38. FIG. 11 shows a food product block 22 loaded onto the support member 160 of the tray 46. The lower surface of the food product block 22 seats on the upper surface of the support member 160 and the front end of the food product block 22 engages against the housing of the product gate 158.

Figure 12:
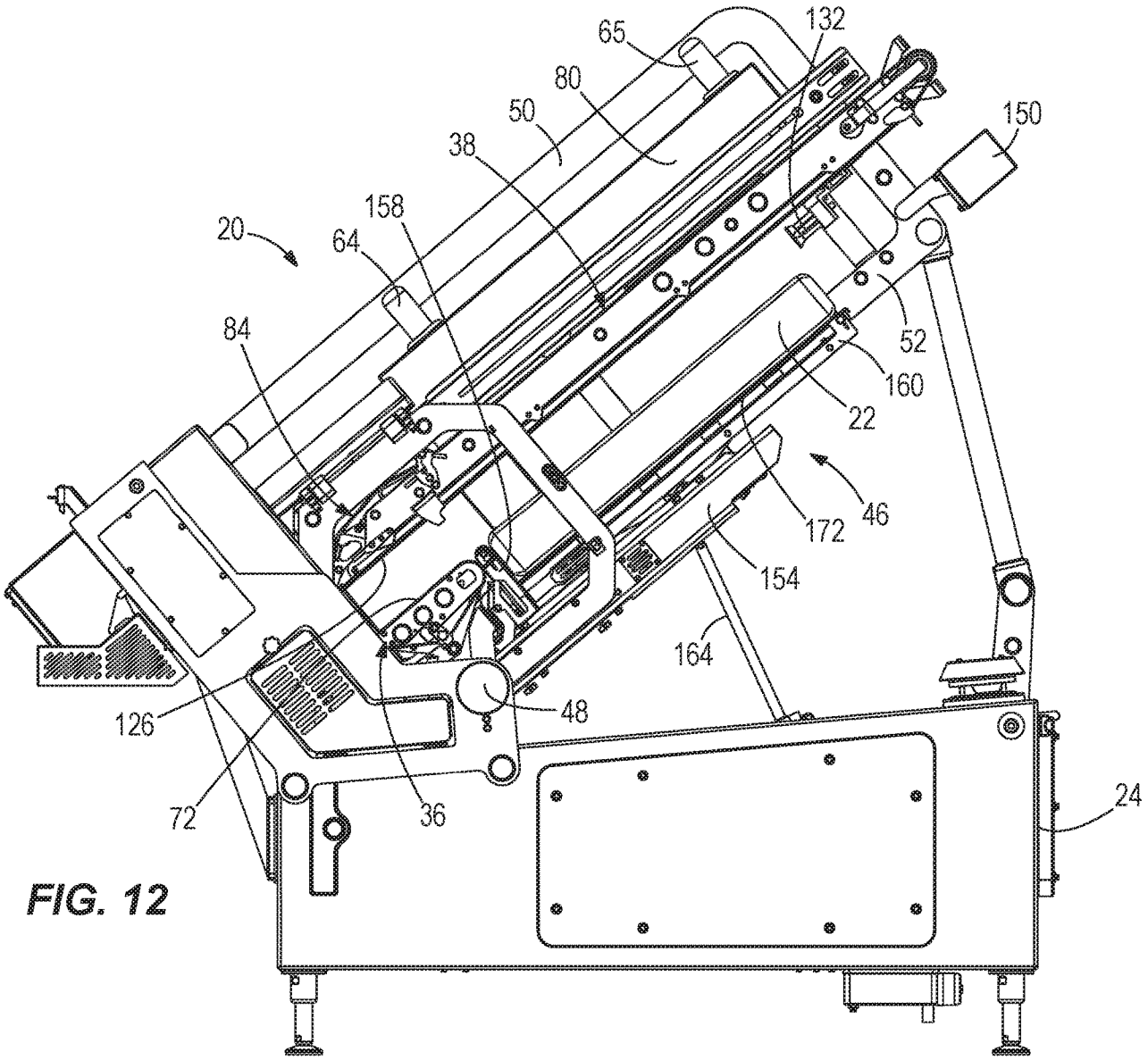
FIG. 12 is an elevation view of the food product slicing apparatus with the tray in an upward and forward position, according to one aspect of the present disclosure.

Once the food product block 22 is loaded onto the support member 160, the drive mechanism 164 is engaged to rotate the tray 46 upward around pivot 48, as shown in FIG. 12, such that the planar top surface 172 of the support member 160 is parallel to the planar upper surfaces 72 of the lower drive assembly 36 and parallel to the planar lower surfaces 126 of the upper drive assembly 38. Next, the drive mechanism 155 is engaged to translate the tray 46 forward toward the lower drive assembly 36, as shown in FIG. 12. The support member 160 translates relative to the base 154 in a direction parallel to a longitudinal extent of the tray 46. In this position, the butt receiving wall 156 is positioned underneath the lower drive assembly 36. The product gate 158 remains positioned in front of the food product blocks 22. The support member 160 supports the food product blocks 22 from below and the product gate 158 supports the food product blocks 22 from the front. The food product sensor 150 determines the length of the food product blocks 22 and communicates this information to the control system 30.

Figure 13:
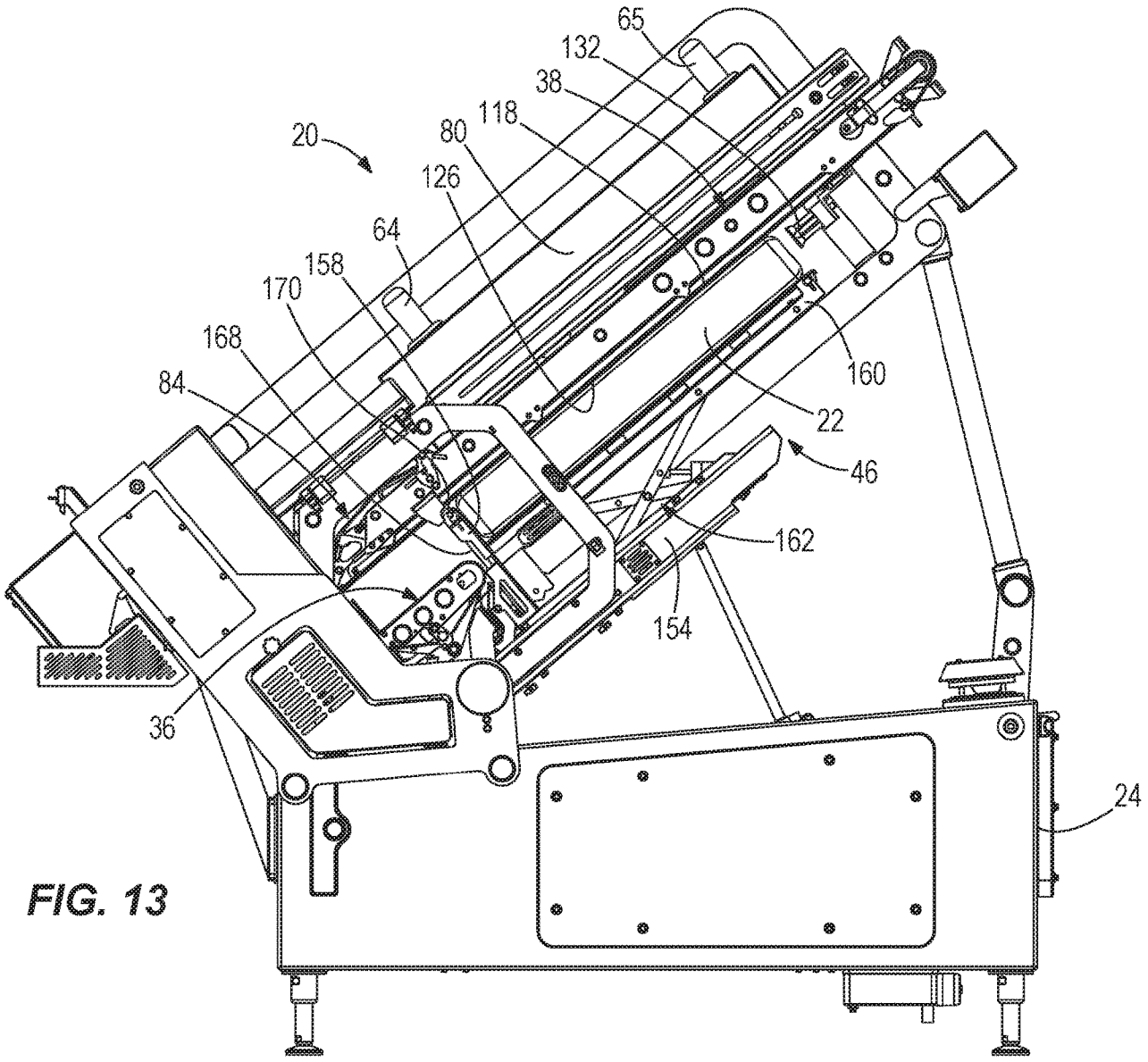
FIG. 13 is an elevation view of the food product slicing apparatus with the tray moved further upward to a loading position, according to one aspect of the present disclosure.
Figure 14:
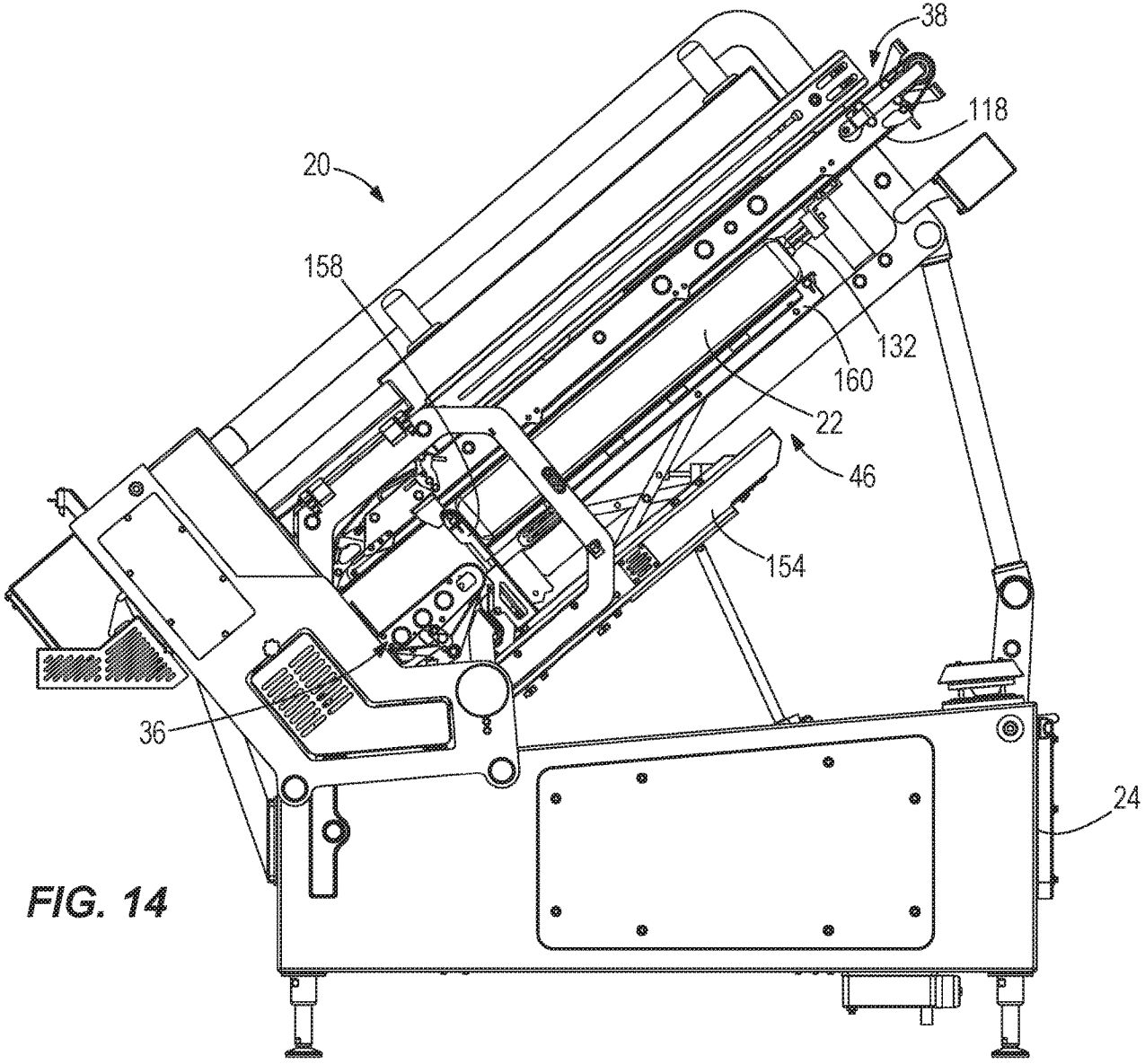
FIG. 14 is an elevation view of the food product slicing apparatus with one example of grippers grasping a rear of the food product block, according to one aspect of the present disclosure.

As shown in FIG. 13, the drive mechanism 162 is engaged to move the support member 160 upwardly relative to the base 154 and to engage the portions of the planar surfaces 126 of the upper drive assembly 38 that are upstream of the lower drive assembly 36. The product gate 158 is also activated to extend the rods 168 upwardly such that the food product blocks 22 engage against the rods 168. In this position, the rods 168 of the product gate 158 remain positioned in front of the support member 160. The grippers 132 are activated to engage and grasp the rear ends of the food product blocks 22 as shown in FIG. 14. The support member 160 supports the food product blocks 22 from below, the product gate 158 supports the food product blocks 22 from the front, and the upper drive assembly 38 engages the upper surfaces of the food product blocks 22, thereby limiting forward movement of the food product blocks 22 in a forward direction and preventing the food product blocks 22 from moving toward the slicing station 42. In the illustrated example, the belts 118 engage the food product blocks 22 along an entire length of the blocks 22. Engaging the blocks 22 along an entire length thereof provides a significant engagement area between the belts 118 and the food product blocks 22, thereby improving control of the food product blocks 22 during various operations of the food product slicing apparatus 20. In other examples, the belts 118 may engage the food product blocks 22 along significant portions of the lengths of the food product blocks 22. In further examples, the belts 118 may engage the food product blocks 22 along a majority of the lengths of the food product blocks 22.

Figure 15:
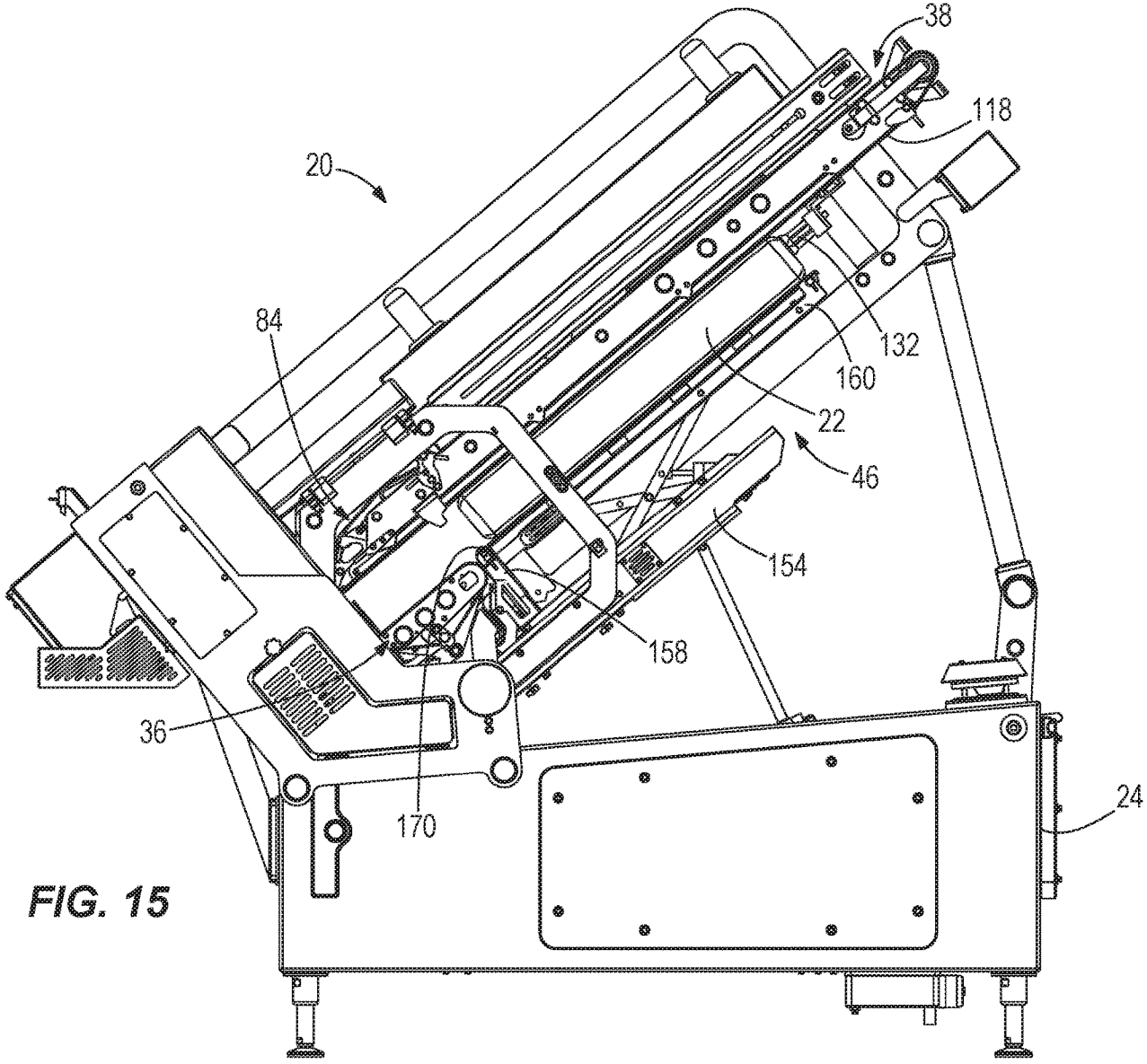
FIG. 15 is an elevation view of the food product slicing apparatus with one example of a product gate moved to a downward position, according to one aspect of the present disclosure.

Referring now to FIG. 15, the rods 168 and rollers 170 of the product gate 158 are lowered out from in front of the food product blocks 22 until the tops of the rollers 170 are aligned with the upper surface of the support member 160. The food product blocks 22 remain in position after lowering of the product gate 158 due to the grippers 132 grasping a rear of the food product blocks 22 and engagement of the belts 118 with the top surface of the food product blocks 22. A food product block 22 may have a substantial weight depending on a size of the food product block 22 and the type of food product. In some cases, grippers 132 may disengage or fail to grip a rear end of the food product block 22. Without engagement of the belt 118 with the top surface of the food product block 22, the food product block 22 would move uncontrollably along the feed path 146 toward the slicing station 42 if the grippers 132 fail. Uncontrolled falling or movement of the food product block 22 along the feed path 146 toward the slicing station 42 may damage components of the food product slicing apparatus 20 or may cause misalignment of the food product block 22, thereby causing operation downtime to repair and/or reposition/realign the food product block 22. Thus, engagement of the food product blocks 22 with the belts 118 of the upper drive assembly 38 provides continuous control of the food product blocks 22.

Figure 16:
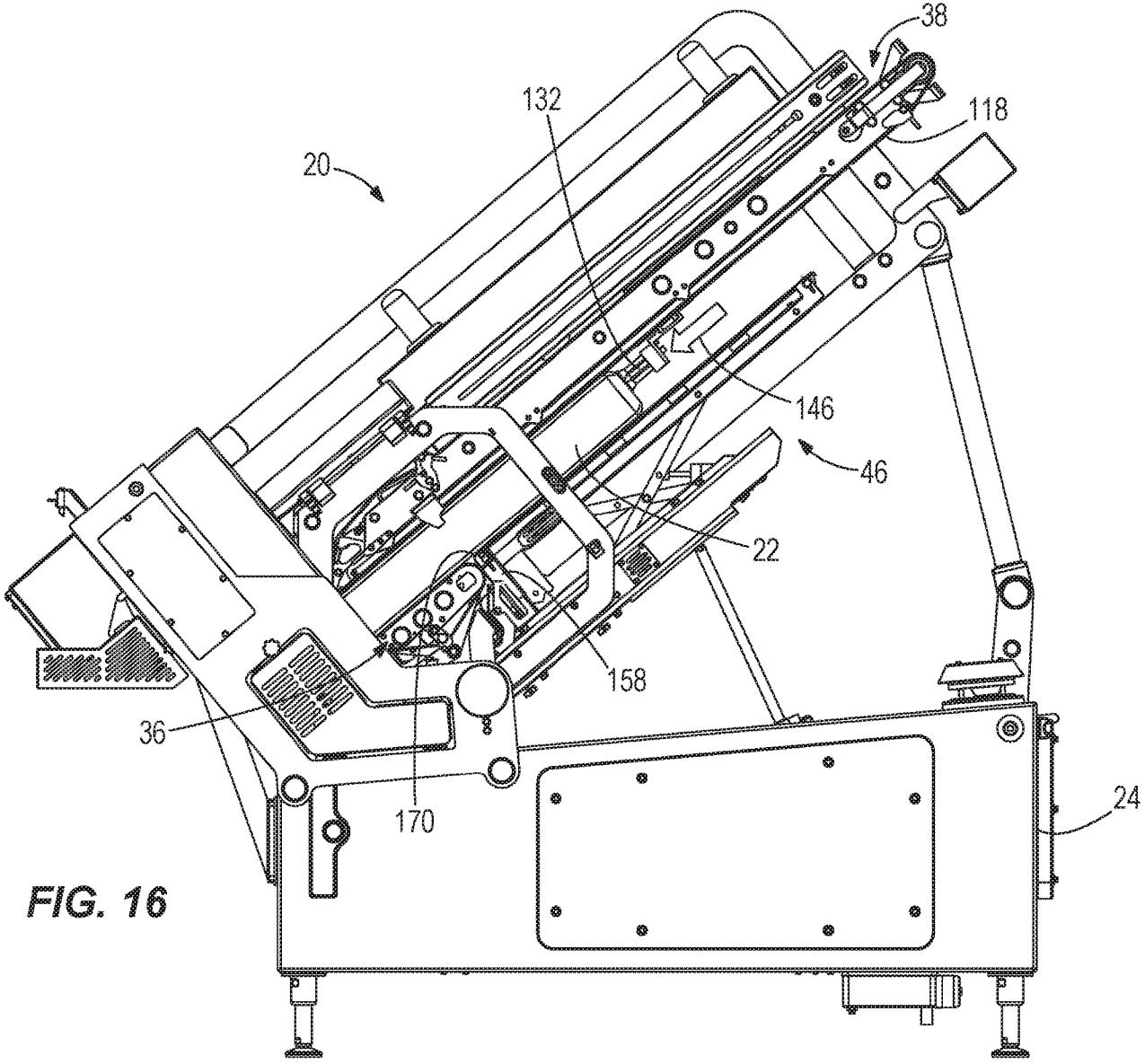
FIG. 16 is an elevation view of the food product slicing apparatus with the food product block driven forward toward a slicing station by one example of an upper drive assembly and one example of a lower drive assembly, according to one aspect of the present disclosure.

Referring now to FIG. 16, the upper drive assembly 38 is engaged to move the food product blocks 22 along their feed paths 146 toward and along the lower drive assembly 36. The food product blocks 22 roll over the rollers 170 of the product gate 158 as they translate onto the lower drive assembly 36. The upper drive assembly 38 drives the food product blocks 22 into engagement with the lower drive assembly 36. In one example, the belts 66, 118 of the lower and upper drive assemblies 36, 38 are driven at the same rate. In another example, the belts 66, 118 of the lower and upper drive assemblies 36, 38 may be driven at different rates. In further examples, sets of upper and lower belts 66, 118 associated with individual food product blocks 22 may be driven independent of other sets of upper and lower belts 66, 118 to drive food product blocks 22 along their feed paths 146 at different rates. Upon engagement of the food product blocks 22 with the lower belts 66, the food product blocks 22 are driven along their respective feed paths 146 by both the lower and upper drive assemblies 36, 38.

The pressure adjustment assemblies 84 may be activated to apply varying pressures to top surfaces of the food product blocks 22 near the front ends of the food product blocks 22 to inhibit movement of the front ends of the food product blocks 22 prior to inserting into the shear edge 40. The pressure adjustment assemblies 84 assist with ensuring the food product blocks 22 are properly aligned with the apertures 148 in the shear edge 40 to facilitate insertion of the blocks 22 into the apertures 148 without interference with edges of the apertures 148, other portions of the shear edge 40 or other portions of the food product slicing apparatus 20. During activation of the pressure adjustment assemblies 84 which are best shown in FIG. 8, the drive members 144 are activated which causes the drive members 144 to bear against the shafts 142. This causes the plates 138, 140 and associated wheels 120 to pivot around pivot shaft 134, which moves wheels downwardly toward the lower drive assembly 36. In one example, the pressure adjustment assemblies 84 all apply a similar pressure to top surfaces of the food product blocks 22. In other examples, the pressure adjustment assemblies 84 may be individually controlled to apply different pressures to different food product blocks 22. Additionally, heights of the pressure adjustment assemblies 84 may be adjusted by using the drive members 144 to pivot the wheels 120 to accommodate various heights of food product blocks 22. In one example, the pressure adjustment assemblies 84 all have the same height. In other examples, the pressure adjustment assemblies 84 may be individually controlled to have different heights relative to each other to accommodate food product blocks 22 having different heights. In one example, the pressure adjustment assemblies 84 may be moved to accommodate a height difference of the food product blocks 22 of about 1.5 inches. In another example, the pressure adjustment assemblies 84 may be moved to accommodate a height difference of the food product blocks 22 of more than 1.5 inches.

Figure 17:
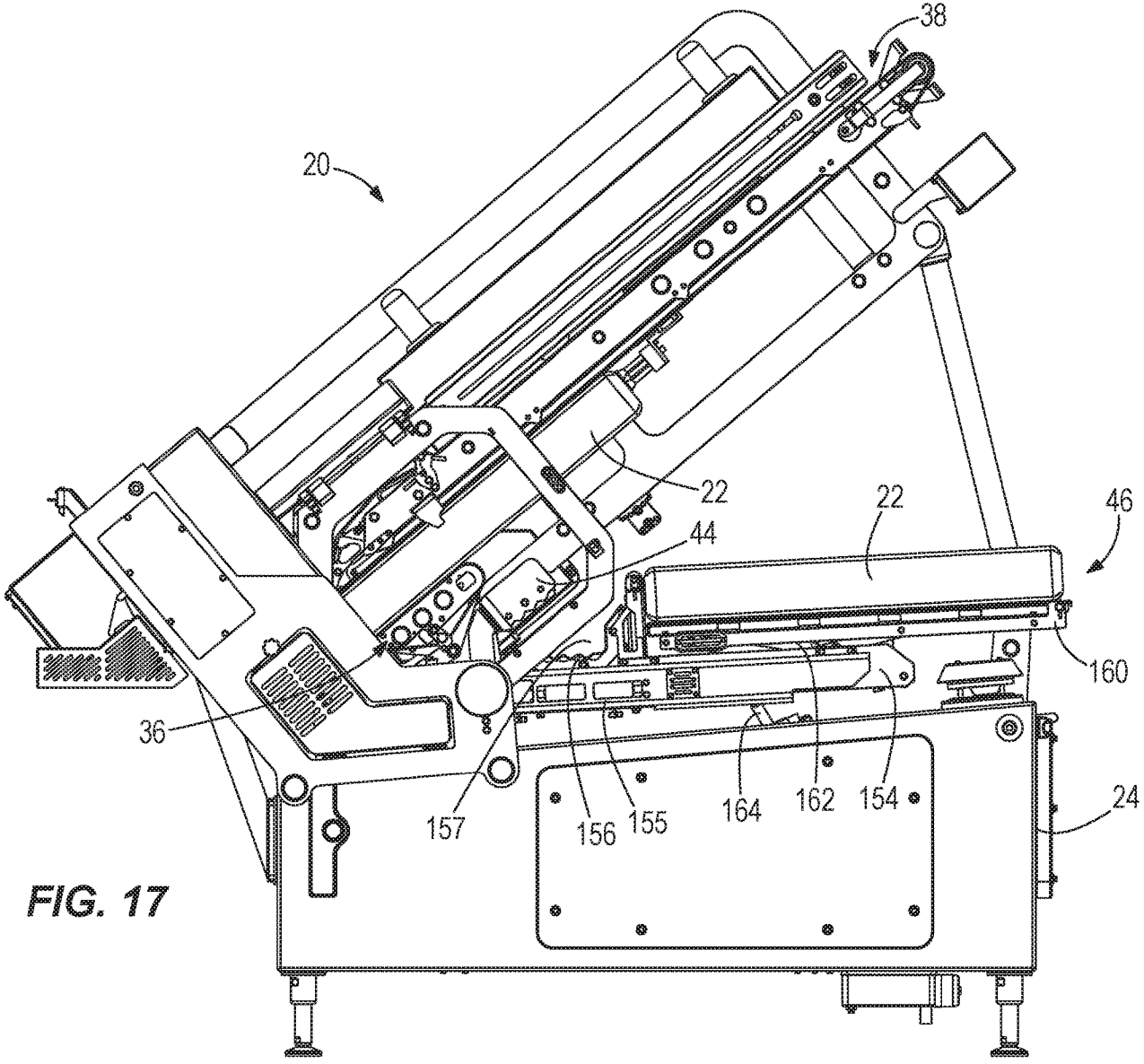
FIG. 17 is an elevation view of the food product slicing apparatus with a second food product block loaded onto the tray while slicing is being performed on the first food product block, according to one aspect of the present disclosure.

Referring now to FIG. 17, with the food product blocks 22 sufficiently advanced along their feed paths 146 into the slicing station 42 (not shown in FIG. 17), the tray 46 may return back to its initial position as shown in FIG. 11. The support member 160 moves toward the base 154 by activating the drive mechanism 162, then the tray 46 translates away from the slicing station 42 by activating the drive mechanism 155 such that the butt receiving wall 156 is proximate to the upstream end of the lower drive assembly 36 and aligns with the removal member 44. The tray 46 then rotates downward toward the base 24 by using drive mechanism 164. Another set of food product blocks 22 may then be loaded onto the tray 46.

Figure 18:
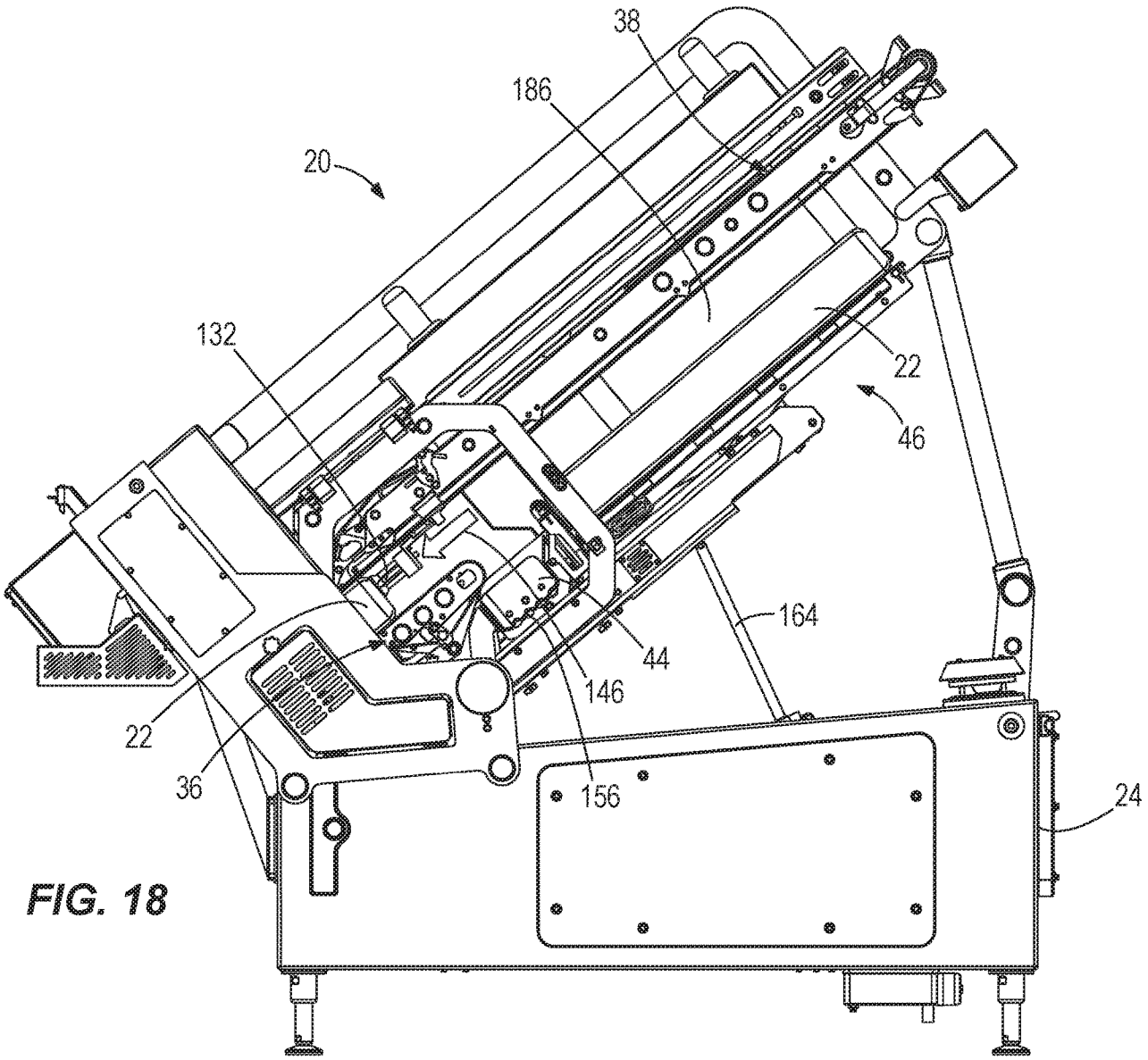
FIG. 18 is an elevation view of the food product slicing apparatus with slicing operation of the first food product block near completion and the second food product block raised to an upward and rearward position, according to one aspect of the present disclosure.

With reference to FIG. 18, the lower and upper drive assemblies 36, 38 continue to drive the food product blocks 22 along their feed paths 146 into the slicing station 42. Upon loading of new food product blocks 22, the tray 46 rotates upward using drive mechanism 164, but is positioned below the feed paths 146 and displaced below the upper drive assembly 38. This spacing 186 of the new food product blocks 22 and the upper drive assembly 38 allows retraction of the grippers 132 to a rear of the new food product blocks 22.

Figure 19:
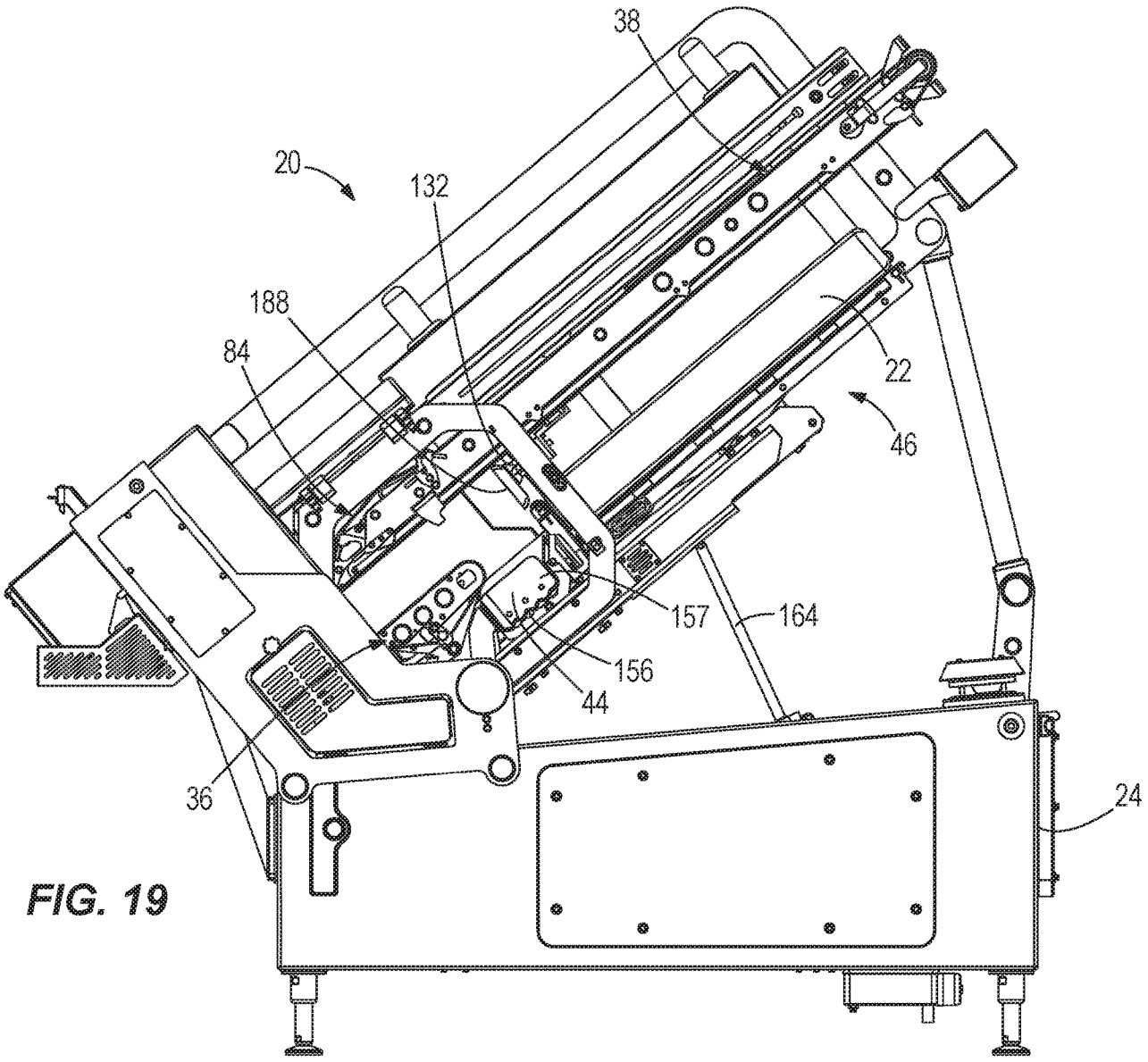
FIG. 19 is an elevation view of the food product slicing apparatus with slicing operation of the first food product block completed and the grippers moving a butt of the first food product block rearward away from the slicing station, according to one aspect of the present disclosure.
Figure 20:
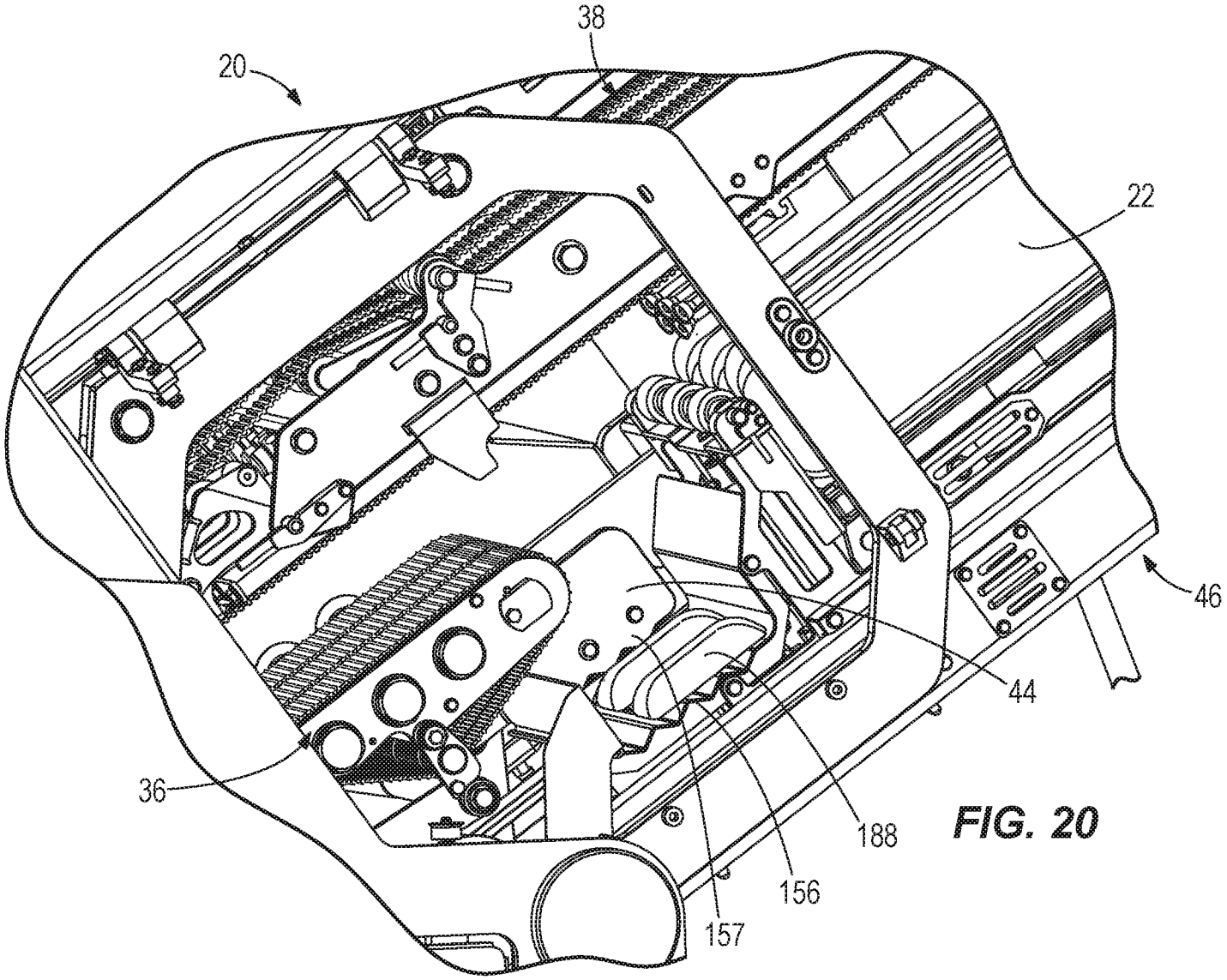
FIG. 20 is a top, front perspective view of a portion of the food product slicing apparatus with the butt of the first food product block dropped into one example of a butt or end cavity defined by the slicing apparatus, according to one aspect of the present disclosure.

Referring now to FIG. 19, the food product slicing apparatus 20 does not facilitate slicing of the entire food product blocks 22. The remaining, unsliced portion of a food product block 22 is referred to as a "butt" 188. Upon completion of the slicing operation of the food product blocks 22, the lower and upper drive assemblies 36, 38 reverse driving directions and the butts 188 of the food product blocks 22 move rearward away from the slicing station 42 while still be grasped by the grippers 132. As the butts 188 and the grippers 132 pass over the butt receiving wall 156, the grippers 132 release the butts 188 and the butts 188 drop into the cavity 157 formed by the butt receiving wall 156. The removal member 44 is activated to move butts 188 out of the butt receiving wall 156. In the illustrated example, the removal member 44 pushes the butts 188 out of the cavity 157 to a side of the food product slicing apparatus 20. The food product slicing apparatus 20 includes a side chute 200 through which the butts 188 pass out of the cavity 157 of the butt receiving wall 156 and to a side of the food product slicing apparatus 20. During operation, the removal member 44 moves outward to push the butts 188 out of the cavity 157 of the butt receiving wall 156 to a side of the food product slicing apparatus 20 and then retracts to its inward at rest position. In some examples, the removal member 44 may pull the butts 188 out of the cavity 157 of the butt receiving wall 156. In other examples, the removal member 44 may rotate to cause the butts 188 to move out of the cavity 157 of the butt receiving wall 156. In further examples, the removal member 44 may move in a variety of directions relative to the feed paths 146 and the food product slicing apparatus 20 such as, for example, parallel to the feed paths 146, transverse to the feed paths 146, in a direction between parallel and perpendicular to the feed paths 146, or any other direction. It should be understood that the removal member 44 may be configured in a wide variety of manners and move in a variety of different directions, and all of such possibilities are intended to be within the spirit and scope of the present disclosure.

Thereafter, the food product slicing apparatus 20 moves to the condition shown in FIG. 11 as described herein and the operation is restarted.

Figure 7:
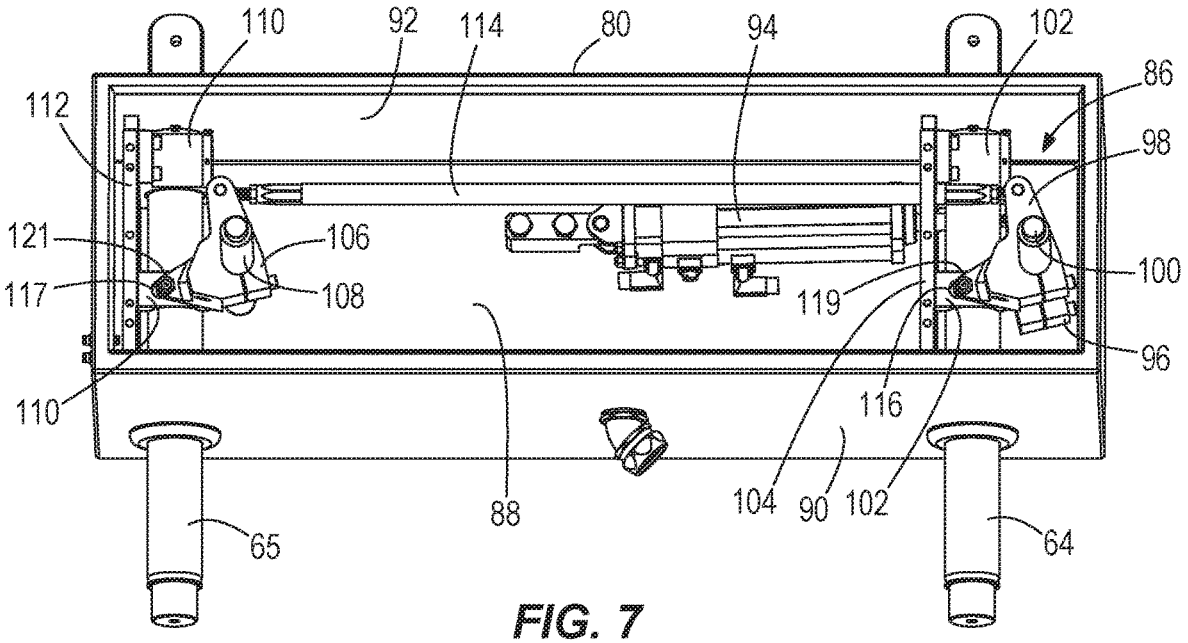
FIG. 7 is a cross-sectional view of a portion of the food product slicing apparatus showing the height adjustment assembly.
Figure 7A:
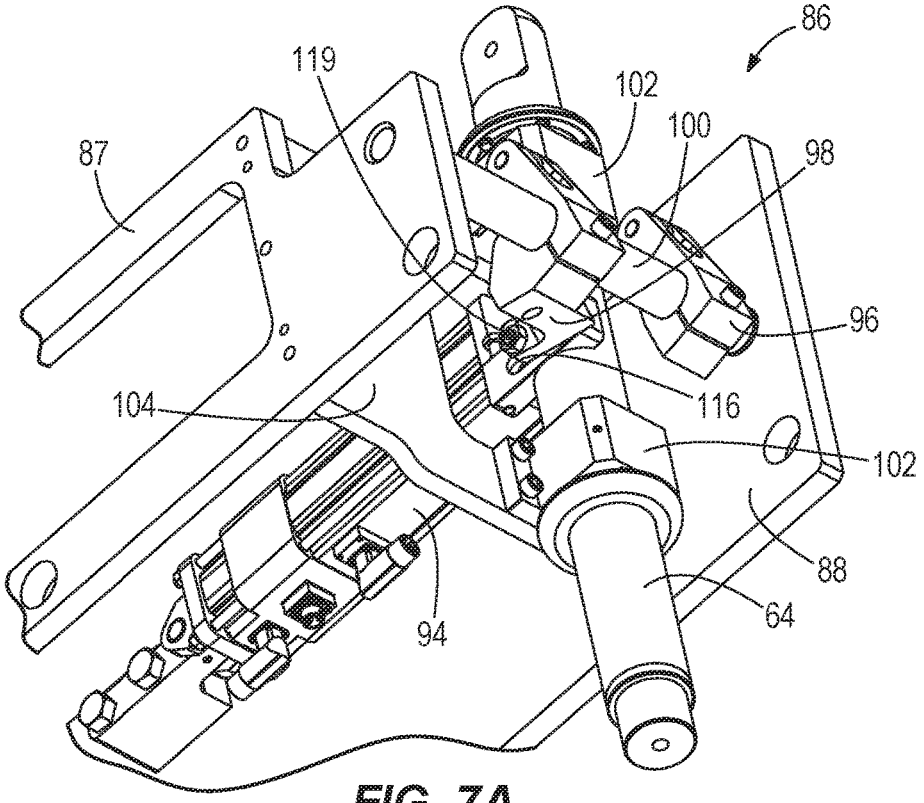
FIG. 7A is an alternate cross-sectional view of a portion of the food product slicing apparatus showing the height adjustment assembly.

With particular reference to FIGS. 7 and 7A, the height adjustment assembly 86 is used adjust the height of the upper drive assembly 38 relative to the lower drive assembly 36 to accommodate food product blocks 22 of different heights. The height adjustment assembly 86 is controlled by the control system 30.

In use, the actuator 94 is extended which causes the rocker member 96 and the pivot members 98, 106 to pivot relative to the side walls 87, 88 of the housing 80. When the pivot members 98, 106 pivot, the pins 119, 121 slide along the cam slots 116, 117. Since the pivot shafts 100, 108 are attached to the side walls 87, 88, when the pivot members 98, 106 pivot, this causes the housing 80 to translate upwardly. Since the connecting frames 104, 112, are attached to the slide members 102, 110, the slide members 102, 110 slide upwardly along the rods 64, 65. Since the upper drive assembly 38 is attached to the housing 80, the movement increases the spacing between the lower and upper drive assemblies 36, 38. To reduce the spacing between the lower and upper drive assemblies 36, 38, the actuator 94 is retracted which causes the rocker member 96 and the pivot members 98, 106 to pivot relative to the side walls 87, 88, and the pins 119, 121 to slide the opposite direction in the cam slots 116, 117. The housing 80 translates downwardly and the slide members 102, 110 slide downwardly along the rods 64, 65.

The housing 80 and attached upper drive assembly 38 move to provide a sufficient distance or space 192 between the upper and lower belts 66, 118 to allow the food product blocks 22 to move along their feed paths 146 between the upper and lower belts 66, 118. The position to which the upper drive assembly 38 moves also ensures contact of the upper belts 118 with top surfaces of the food product blocks 22. The food product slicing apparatus 20 has significant flexibility to accommodate food product blocks 22 of varying heights. This flexibility is provided by the combination of the movable upper drive assembly 38 and the movable pressure adjustment assemblies 84 at the front of the upper drive assembly 38.

A drive mechanism 184 is mounted between the base 24 and the input and slicing portion 26 to lift the entire input and slicing portion 26 relative to the base 24 for cleaning purposes. The mechanism 184 may include a wide variety of types of drive members including, but not limited to, pneumatic, hydraulic, screw drive, electronic, etc., and all of such possibilities are intended to be within the spirit and scope of the present disclosure. This enables the food product slicing apparatus 20 to be oriented at an angle $\alpha$ relative to the base 24 and the ground surface 32 upon which the food product slicing apparatus 20 is supported. The input and slicing portion 26 may be oriented at a variety of different angles relative to the base 24 and the ground surface 32, and all of such possibilities are intended to be within the spirit and scope of the present disclosure.

Figure 4:
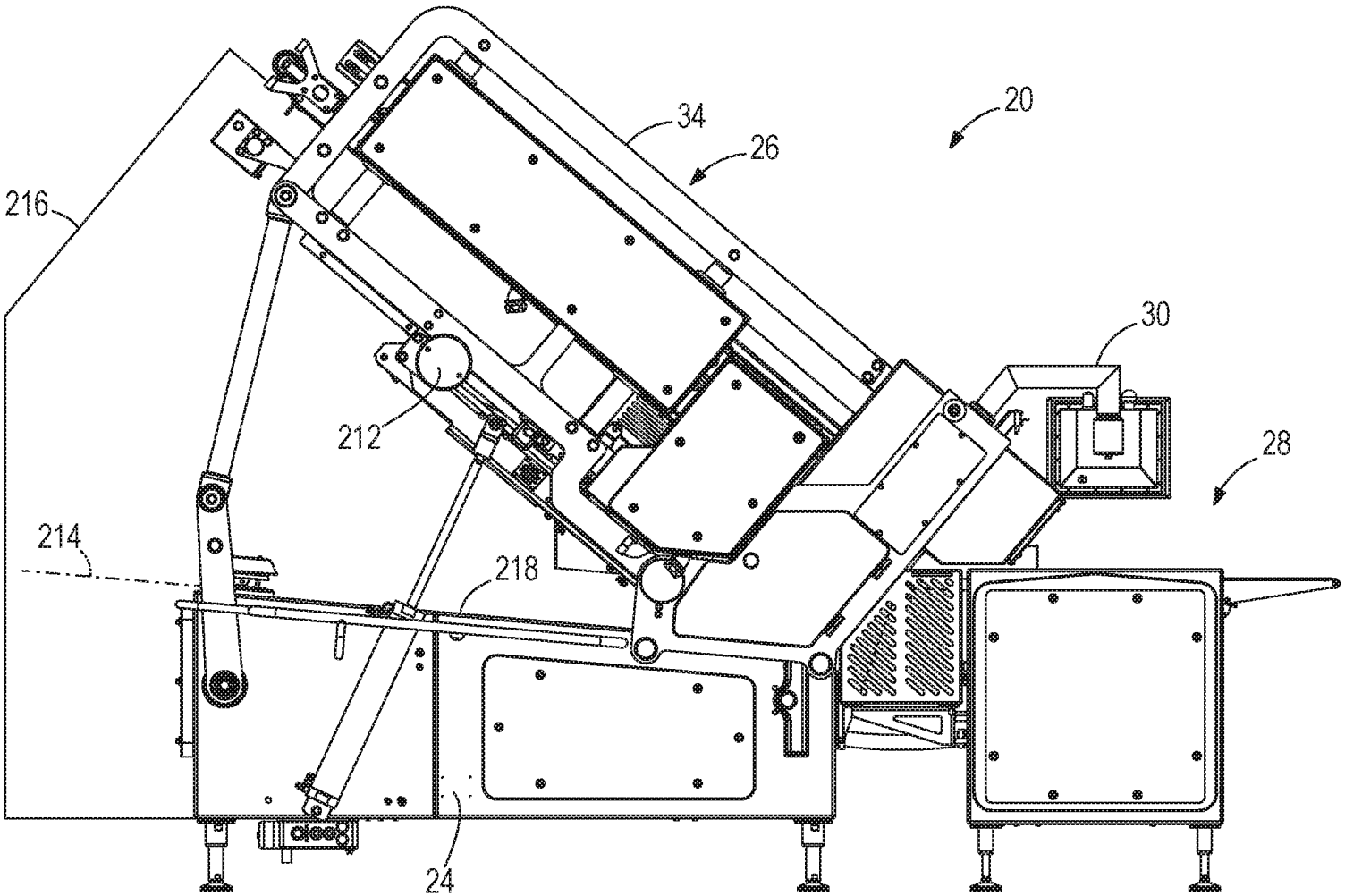
FIG. 4 is a rear elevation view of the food product slicing apparatus illustrating one example of a second zone sensed by a second sensor, according to one aspect of the present disclosure.

With reference to FIGS. 1 and 3, the food product slicing apparatus 20 includes two safety sensors 210, 212 for sensing various areas around the food product slicing apparatus 20 to inhibit users or other individuals from entering dangerous areas of the food product slicing apparatus 20. The sensors 210, 212 are in communication with the control system 30. The two sensors 210, 212 operate on two different planes. The first sensor 210 is coupled to the base 24 and senses a first area 214 in a plane generally parallel to a top surface 218 of the base 24 (see FIGS. 3 and 4). The second sensor 212 is coupled to the input and slicing portion 26 and senses a second area 216 in a generally vertical plane perpendicular to the first sensed area 214 and the ground surface 32 upon which the food product slicing apparatus 20 is supported. The first and second areas 214, 216 are defined to cover areas around the food product slicing apparatus 20 in which a user or other individual may be injured by the food product slicing apparatus 20 during operation. If one or more of the first or second areas 214, 216 is breached, operation of the food product slicing apparatus 20 will cease until the food product slicing apparatus 20 is reset and the first and second areas 214, 216 are clear. It should be understood that the sensed areas and planes may have different shapes, sizes, configurations, and orientations than those illustrated and described herein, and all of such possibilities are intended to be within the spirit and scope of the present disclosure.

While a particular embodiment is illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiment illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

The invention claimed is:

1. A food product slicing apparatus comprising:

a frame;

an upper drive assembly mounted on the frame and including an upper belt configured to engage a top surface of a food product block to be sliced, a front wheel at a front end of the upper belt, a rear wheel at a rear end of the upper belt, the rear wheel being rotatably mounted on the frame in a first position, plates pivotally mounted on the frame around a fixed in place pivot, the fixed in place pivot being spaced from the rear wheel, the front wheel rotatably mounted on the plates, and a drive member engaged with the plates;

a lower drive assembly mounted in a second position on the frame and including a lower belt, the lower belt configured to engage a bottom surface of the food product block, the upper and lower drive assemblies separated from each other by a distance, wherein when the drive member is engaged, the drive member rotates the plates and the front wheel around the fixed in place pivot so that the plates and the front wheel rotate relative to the frame, relative to the rear wheel, and relative to the lower drive assembly, while the rear wheel remains in the first position mounted on the frame and while the lower drive assembly remains in the second position mounted on the frame, to vary the distance a front end of the upper drive assembly is from the lower drive assembly, while maintaining the distance a rear end of the upper drive assembly is from the lower drive assembly; and a slicing station attached to the frame and downstream of the upper and lower drive assemblies;

wherein (1) the frame includes a rod, and further comprising a height adjustment assembly attached to the rod, the upper drive assembly mounted on the height adjustment assembly, the height adjustment assembly mounted within a housing slidably mounted on the rod, an actuator mounted in the housing, a pivot member rotatably mounted to the housing, the pivot member including a pin extending therefrom which mounts in a slot on the rod; or (2) the fixed in place pivot comprising a pivot shaft connected directly to and extending between the plates.

2. The food product slicing apparatus of claim 1, wherein the upper drive assembly includes a plurality of the upper belt, each respective upper belt having a respective front wheel at a respective front end which is rotatably mounted to respective plates pivotally mounted on the frame at a respective fixed in place pivot, a respective rear wheel at a respective rear end rotatably mounted on the frame, and a respective drive member engaged with the respective plates, wherein when the respective drive member engages with the respective plates, the respective plates and respective front wheel each pivot relative to the frame and to the respective rear wheel; and the lower drive assembly includes a plurality of the lower belts.

3. The food product slicing apparatus of claim 1, wherein the drive member is one of pneumatic, hydraulic, screw drive and electronic.

4. The food product slicing apparatus of claim 1, further comprising:

a plurality of output conveyors aligned with the slicing station and adapted to receive stacks of sliced food product from the slicing station.

5. The food product slicing apparatus of claim 4, further comprising weighing scales oriented under the output conveyors.

6. The food product slicing apparatus of claim 5, further comprising a packaging station to package the stacks of sliced food product, the plurality of output conveyors to move the stacks of sliced food product along linear paths from the slicing station to the weighing scales, to the packaging station.

7. The food product slicing apparatus of claim 4, wherein the plurality of output conveyors comprises three output conveyors.

8. The food product slicing apparatus of claim 1, wherein (1) the frame includes the rod, and further comprising the height adjustment assembly attached to the rod, the upper drive assembly mounted on the height adjustment assembly, the height adjustment assembly mounted within the housing slidably mounted on the rod, the actuator mounted in the housing, the pivot member rotatably mounted to the housing, the pivot member including the pin extending therefrom which mounts in the slot on the rod.

9. The food product slicing apparatus of claim 8, wherein the frame includes a second rod, the height adjustment assembly attached to both rods, the height adjustment assembly slidably mounted on the rods, a second pivot member rotatably mounted to the housing, the second pivot member including a second pin extending therefrom which mounts in a second slot on the second rod.

10. The food product slicing apparatus of claim 1, further comprising a gripper attached to the upper belt.

11. The food product slicing apparatus of claim 1, further comprising a tray attached to the frame, the tray being pivotable relative to the upper drive assembly.

12. The food product slicing apparatus of claim 1, wherein (2) the fixed in place pivot comprises the pivot shaft connected directly to and extending between the plates.

13. The food product slicing apparatus of claim 12, wherein the upper drive assembly further comprises a second pair of plates, the second pair of plates fixed in place, the pivot shaft connected directly to and extending between the second pair of plates.

14. The food product slicing apparatus of claim 13, wherein the plates are disposed between the second pair of plates.

* * * * *